US007634888B2

(12) United States Patent
Cloyd et al.

(10) Patent No.: US 7,634,888 B2
(45) Date of Patent: Dec. 22, 2009

(54) LOAD-RESISTING TRUSS SEGMENTS FOR BUILDINGS

(75) Inventors: Kenneth M. Cloyd, Temecula, CA (US); Robert D. Lucey, Lafayette, CA (US)

(73) Assignee: Trussed, Inc., Perris, CA (US)

( * ) Notice: Subject to any disclaimer, the term of this patent is extended or adjusted under 35 U.S.C. 154(b) by 862 days.

(21) Appl. No.: 10/962,185

(22) Filed: Oct. 7, 2004

(65) Prior Publication Data

US 2005/0108986 A1 May 26, 2005

Related U.S. Application Data

(60) Provisional application No. 60/509,683, filed on Oct. 7, 2003.

(51) Int. Cl.
*E04H 12/00* (2006.01)

(52) U.S. Cl. ..... 52/653.1; 52/638; 52/693

(58) Field of Classification Search ..... 52/633, 52/637, 641, 646, 651.1, 653.1, 93.1, 283, 52/638, 648.1, 561.01, 564.1, 693, 694
See application file for complete search history.

(56) References Cited

U.S. PATENT DOCUMENTS 3,156,018 A 11/1964 Slayter
3,234,841 A * 2/1966 Adams ..... 411/467
RE31,234 E * 5/1983 Jureit et al. ..... 403/163
4,639,176 A 1/1987 Smith et al.
4,648,216 A 3/1987 Reaves et al.
4,656,792 A * 4/1987 Clark ..... 52/93.1
5,094,059 A * 3/1992 Ganescu ..... 52/641
5,813,181 A 9/1998 Ashton et al.
5,867,963 A 2/1999 Hershey
5,921,042 A 7/1999 Ashton et al.

(Continued)

FOREIGN PATENT DOCUMENTS

WO WO 01/29338 A2 4/2001

*Primary Examiner*—Richard E Chilcot, Jr.
*Assistant Examiner*—William V Gilbert
(74) *Attorney, Agent, or Firm*—Knobbe Martens Olson & Bear LLP

(57) ABSTRACT

The invention provides load-resisting segments (e.g., panels or frames for openings) for transmitting loads through a building structure. In the context of a wall, the load-resisting segments transmit shear loads downward to structural elements below the wall, such as to a building foundation. The load-resisting segments may comprise a truss configuration, i.e., an assembly of members forming a rigid framework. Each load-resisting segment can include web members and pairs of truss plates secured to sides of the segment to secure connections of the web members to each other and to other members. The wall segments can include beam-separation blocks that reduce truss plate failure by spacing apart the ends of two web members bearing against a chord or post to position the intersection point of the load paths of the web members with the load path of the chord or post. Some of the truss plates can include strips of material to provide additional resistance to tearing of the truss plate due to loads experienced by the truss plate. Some of the load-resisting segments, particularly frames for doors or windows, may include compression plates that prevent point-loading of studs or chords against transversely oriented members. For example, a truss frame may include compression plates between ends of its columns and surfaces of a header or sill structure.

45 Claims, 17 Drawing Sheets

U.S. PATENT DOCUMENTS 6,088,989 A * 7/2000 Matsu et al. ..... 52/655.1
6,158,184 A 12/2000 Timmerman, Sr. et al.
6,308,469 B1 10/2001 Leung
6,389,767 B1 5/2002 Lucey et al.
6,931,804 B2 8/2005 Trarup et al.
2002/0020137 A1 * 2/2002 Commins ..... 52/712
2002/0108332 A1 8/2002 Timmerman

* cited by examiner

70

LOAD-RESISTING TRUSS SEGMENTS FOR BUILDINGS

INCORPORATION BY REFERENCE AND CLAIM FOR PRIORITY

This application claims priority under 35 U.S.C. § 119(e) to Provisional Application Ser. No. 60/509,683, filed Oct. 7, 2003. This application incorporates by reference the entire disclosures of U.S. Pat. Nos. 4,639,176 to Smith et al. (hereinafter "the '176 patent") U.S. Pat. No. 5,921,042 to Ashton et al. (hereinafter "the '042 patent"), and U.S. Pat. No. 6,389,767 to Lucey et al. (hereinafter "the '767 patent").

BACKGROUND OF THE INVENTION

1. Field of the Invention

The present invention relates generally to building construction and more specifically to lateral load-resisting truss segments of buildings, including segments of walls, floors, roofs, ceilings, and the like.

2. Description of the Related Art

It is a well-known principle of building construction that the building must include higher-strength structural segments that resist and transfer loads. These load-transfer segments can be provided in the walls, floors, roof, ceilings, and other portions of the building. For example, the building walls typically include segments that transfer lateral (shear) loads down into the building foundation. Shear loads often result from winds, earthquakes, and the like. In conventional building construction, the shear loads are transmitted horizontally through framing generally known in the industry as diaphragms, and down the lateral load-resisting wall segments to an element that is connected to the foundation. Since loads are naturally transmitted through the stiffest element, the lateral load-resisting wall segments can be positioned at different locations within the overall length of the wall of the building, so long as these wall segments are sufficient in quantity and strength to transmit the expected shear loads. One type of lateral load-resisting wall segment is a shear wall. A shear wall acts as a unitary load-transferring segment. An exemplary shear wall design is disclosed in the '767 patent. This shear wall includes holdowns for securing the shear walls to structural elements below, such as the building foundation.

In order to illustrate these concepts, consider FIG. 1, which shows a conventional building construction. In particular, FIG. 1 shows a two-story house 10 built on a foundation 12. The house 10 includes a lower wall 14 and an upper wall 16. A diaphragm or framing system includes horizontal plates 18 that frame the independent wall segments of walls 14 and 16. Each wall includes a plurality of wall segments 20 and 22. The wall segments 20 are shear walls (each denoted by a large X), which transfer horizontal loads to the foundation below. The wall segments 22 are so-called "non-shear" walls, because they are not designed to transfer lateral loads. The wall segments 22 typically comprise standard or simple frames, and may include a number of vertical studs therein. As shown, the wall segments 22 can include wall openings, such as the windows 24 and the doors 26.

With continued reference to FIG. 1, when the walls 14 and 16 experience shear forces F (which may or may not be equal to one another), these loads are transferred horizontally through the horizontal plates 18 and then downward through the shear walls 20 to the foundation 12.

A typical shear wall comprises wooden members joined together to form a frame structure, with a planar plywood sheathing attached on one or both sides for stability and rigidity. Ordinarily, the plywood is nailed into the frame members. This configuration is expensive because it requires a great deal of plywood and the installation process is labor-intensive. Another disadvantage of this configuration is that the nails often fail and inaccurate nailing is the cause of many lawsuits against building contractors. The nails often miss the studs or are nailed too far into the plywood, thus causing the wall segment to lose some of the lateral load-resisting capacity of the plywood. This can result in excessive wall movement, manifested by cracks and possibly building failure.

While described in the context of walls and wall segments, many of these same problems exist for floor, roof, ceilings, and other building portions. That is, floors, roofs, ceilings, and the like also typically involve plywood nailed into diaphragms, which causes the aforementioned problems: labor-intensive installation and elevated risk of movement and failure.

SUMMARY OF THE INVENTION

Accordingly, it is a principle object of the present invention to provide embodiments that overcome some or all of these limitations. The invention includes improved load-resisting segments (also referred to herein as truss segments) of building walls, floors, ceilings, roofs, and the like. The improved load-resisting building segments of this invention include panels, frames for openings, and even entire walls, floors, ceilings, roofs, and the like. A "panel" refers to a building segment that transmits loads but does not include an opening. As used herein, an "opening" includes openings for any of a variety of different types of internal elements of a wall, floor, roof, ceiling, or the like. For example, a "wall opening" includes openings for any of a variety of different types of doors or windows (such as single doors, double-doors, sliding doors, garage doors, etc.), as well as openings that do not include anything (i.e., an open pathway). An "opening" can also refer to, for example, an opening within a roof (e.g., a skylight), floor (e.g., stairway to basement or lower story), and ceiling (e.g., a passage to an attic).

The load-resisting building segments of this invention preferably serve as the primary load-transmission portions of the building. For example, the wall segments of this invention preferably transmit shear loads downward to structural elements below the wall, such as to a building foundation or framing system of a lower story of the building. The improved load-resisting building segments described herein each comprise a truss configuration, i.e., an assembly of members forming a substantially rigid framework. Bundles of load-resisting building segments may be packaged together assembled on-site when a building is being built. Also, the invention includes a kit of pieces that can be assembled together to form any of the truss segments described below. Specifically, a kit of the invention can include any combination of the pieces required to form any one of the truss segments described below. Finally, the invention includes methods of manufacturing the truss segments.

In one aspect, the present invention provides a substantially rigid frame for an opening of a wall of a building, comprising first and second substantially vertical columns, a substantially horizontal header, and a plurality of truss plates secured to sides of the columns and the header. The second column is spaced laterally from the first column so that a wall opening can be formed therebetween. The wall opening is configured to receive one of a door and a window. The header has a first end positioned above the first column and a second end positioned above the second column. The header, the columns, and the truss plates collectively comprise a substantially rigid framework through which loads can be transmitted into a structural element below the wall. Each of the first and second columns comprises a first pair of substantially vertical studs laterally spaced from one another, and a holdown positioned between and secured to the studs and to the structural element below the wall to prevent the studs from moving upward relative to the structural element.

In another aspect, the present invention provides a segment of a wall of a building, the wall formed above a structural element of the building. The wall segment comprises first, second, and third substantially vertical studs, a holdown, first and second web members, and a small beam-separation block. The second stud is spaced from the first stud, and the third stud is spaced from the second stud so that the second stud is between the first and third studs. The holdown is secured to the first and second studs and to the structural element below the wall to prevent the first and second studs from moving upward relative to the structural element. The holdown comprises a rigid member positioned between and secured directly to both the first and second studs, and a substantially vertical rod having an upper portion engaged with the rigid member so that the rigid member is prevented from moving upward relative to the rod. The rod also has a lower portion secured to the structural element below the wall.

The first web member is oriented diagonally between the second and third studs. The first web member has a top end with a lateral surface bearing against the third stud. The first web member also has a bottom end with a lateral surface and a bottom surface, the lateral surface bearing against the second stud. The beam-separation block has a top surface, a lateral surface, and a bottom surface. The top surface of the beam-separation block bears against the bottom surface of the bottom end of the first web member. The lateral surface of the beam-separation block bears against the second stud. The second web member is oriented diagonally between the second and third studs. The second web member has a top end with a top surface and a lateral surface, the top surface bearing against the bottom surface of the beam-separation block and the lateral surface bearing against the second stud. The second web member also has a bottom end with a lateral surface bearing against the third stud. The beam-separation block is sized and shaped so that a load path defined by the first web member and a load path defined by the second web member intersect substantially on a line that is collinear with the rod.

In another aspect, the present invention provides a segment of a wall of a building, the wall formed above a structural element of the building. The wall segment comprises first, second, and third substantially vertical studs, first and second web members, and a holdown secured to the first and second studs and to the structural element below the wall to prevent the first and second studs from moving upward relative to the structural element. The second stud is spaced from the first stud, and the third stud is spaced from the second stud so that the second stud is between the first and third studs. The holdown comprises a rigid member positioned between and secured directly to both the first and second studs, and a substantially vertical rod having an upper portion engaged with the rigid member so that the rigid member is prevented from moving upward relative to the rod. The rod also has a lower portion secured to the structural element below the wall. Each of the first and second web members is oriented diagonally between the second and third studs. The first web member defines a first load path and has a top end bearing against the third stud and a bottom end bearing against the second stud. The second web member defines a second load path and has a top end bearing against the second stud and a bottom end bearing against the third stud. The web members are oriented so that the first and second load paths intersect substantially on a line that is collinear with the rod.

In another aspect, the present invention provides a load-resisting segment of a building structure, the segment comprising an elongated load transmission structure, a beam generally parallel to and spaced from the load transmission structure, first and second web members, a small web-spacer block, and a truss plate secured to sides of the load transmission structure, the first web member, the second web member, and the web-spacer block. Each of the web members is oriented diagonally between the beam and the load transmission structure. The first web member has a top end with a lateral surface bearing against the beam. The first web member also has a bottom end with a lateral surface and a bottom surface, the lateral surface bearing against the load transmission structure. The web-spacer block has a top surface, a lateral surface, and a bottom surface. The top surface of the web-spacer block bears against the bottom surface of the bottom end of the first web member, and the lateral surface of the web-spacer block bears against the load transmission structure. The second web member has a top end with a top surface and a lateral surface, the top surface bearing against the bottom surface of the web-spacer block and the lateral surface bearing against the load transmission structure. The second web member also has a bottom end with a lateral surface bearing against the beam. The web-spacer block is sized and shaped so that a line that is collinear with a primary load path of the first web member and a line that is collinear with a primary load path of the second web member intersect substantially on a primary load path of the load transmission structure.

In another aspect, the present invention provides a load-resisting segment of a building structure, comprising a substantially rigid framework of beams forming a truss, a plate secured to a side of the framework of beams, and a strip of material secured to the plate. The plate fixes a set of the beams together at connection points therebetween. The plate overlies portions of the set of beams. Each of the portions of the set of beams defines a load path and is configured to transmit loads that are shared by the plate. When the framework of beams is under a load, the load paths result in a first net load in a first portion of the plate and a second net load in a second portion of the plate. The directions of the first and second net loads are generally opposite to one another. The strip of material is secured to the plate along a border between the first and second portions of the plate. The strip of material is configured to resist tearing of the plate along the border.

In another aspect, the present invention provides a substantially rigid load-resisting frame for an opening of a building structure, comprising first, second, and third structural borders for the opening, and first and second truss plates. The first structural border comprises a first elongated load transmission structure and a second elongated load transmission structure that is generally parallel to and spaced laterally from the first load transmission structure. Similarly, the second structural border comprises a third elongated load transmission structure and a fourth elongated load transmission structure that is generally parallel to and spaced laterally from the third load transmission structure. The second structural border is spaced laterally from the first structural border so that the opening is formed between the second and third load transmission structures. The third structural border has a first end portion positioned adjacently to an end of the first structural border and a second end portion positioned adjacently to an end of the second structural border. The structural borders collectively comprise a substantially rigid framework. The first truss plate is secured to front sides of the first load transmission structure and the third structural border. The second truss plate is secured to front sides of the second load transmission structure and the third structural border. The first and second truss plates overlie a majority of the entire distance between the first and second load transmission structures. The first and second truss plates share loads transmitted between the first and third structural borders.

In another aspect, the present invention provides a load-resisting segment of a building structure, comprising a first beam, a second beam having a side positioned at an end of the first beam, and a compression plate interposed between the end of the first beam and the side of the second beam. The compression plate spreads out loads transmitted from the first beam into the second beam.

In another aspect, the present invention provides a substantially rigid frame for an opening of a wall of a building, comprising first and second substantially vertical columns, a substantially horizontal header, a plurality of substantially horizontal compression plates, and one or more truss plates. The first column comprises a first substantially vertical post and a second substantially vertical post spaced laterally from the first post. Similarly, the second column comprises a third substantially vertical post and a fourth substantially vertical post spaced laterally from the third post. The second column is spaced laterally from the first column so that the second and third posts define ends of a wall opening configured to receive one of a door and window. The header has a first end positioned above the first column and a second end positioned above the second column, the header and columns collectively comprising a substantially rigid framework. The compression plates are interposed between upper ends of the posts and lower surfaces of the header. The one or more truss plates are secured to a side of the header and to a side of at least one of the posts. The one or more truss plates are configured to share loads transmitted within the header and/or posts. The frame is configured so that loads within the header are transmitted vertically through the columns to a structural element of the building, the structural element being below the wall.

In another aspect, the present invention provides a load-resisting segment of a building structure, comprising a plurality of beams joined together to form a rigid framework, and a truss plate having teeth formed by punching through the truss plate. A side of the truss plate is secured to a side of the framework with the teeth piercing into the framework. The truss plate secures connections between two or more of the beams. The side of the truss plate includes a first set of one or more portions in direct contact with said two or more of the beams and a second set of one or more portions not in contact with said two or more of the beams. At least one of the second set of one or more portions is devoid of the teeth.

In another aspect, the present invention provides a load-resisting segment of a building structure, comprising a plurality of beams joined together to form a rigid framework, and a truss plate having a side secured to a side of the framework. The truss plate secures connections between two or more of the beams. The side of the truss plate includes a first set of one or more portions in direct contact with said two or more of the beams and a second set of one or more portions not in contact with said two or more of the beams. At least one of the second set of one or more portions includes ribs for increasing the strength of the truss plate.

In another aspect, the present invention provides a wall segment without any openings. The wall segment comprises a substantially horizontal bottom chord, a substantially horizontal top chord spaced above the bottom chord, a plurality of substantially vertical studs extending between the top and bottom chords, truss plates securing connections of the studs to the top and bottom chords, and a holdown positioned between and secured to both studs of a pair of the studs. The holdown is also secured to a structural element below the wall segment to prevent the pair of studs from moving upward relative to the structural element.

In another aspect, the present invention provides a method of manufacturing a truss segment. A plurality of beams is provided on a substantially flat surface, and the beams are arranged into a desired truss framework. Two holdowns are also provided on the flat surface, each holdown being positioned between and secured to both beams of a pair of the beams. Each holdown comprises a rigid member positioned between and secured directly to both beams of the pair of beams, and a rod having an end portion engaged with the rigid member so that the rigid member is prevented from moving in one direction relative to the rod. A first set of truss plates is secured onto a first side of the framework. Each of the truss plates secures connections of the beams to each other.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

While described below primarily in the context of walls, skilled artisans will readily appreciate that the teachings of the present invention can be extended to other building portions, including floors, ceilings, roofs, and the like. Thus, the invention is not limited to components for use within walls, but also includes components for use within floors, ceilings, roofs, and the like.

The present invention provides the wood construction industry with prefabricated wall components that can be easily assembled into the building structure on a construction site. The wall components of the invention advantageously utilize truss plates and wood framing to provide a stronger lateral load-resisting wall segment than those of the prior art.

Truss Frames for Wall Openings

Figure 1:
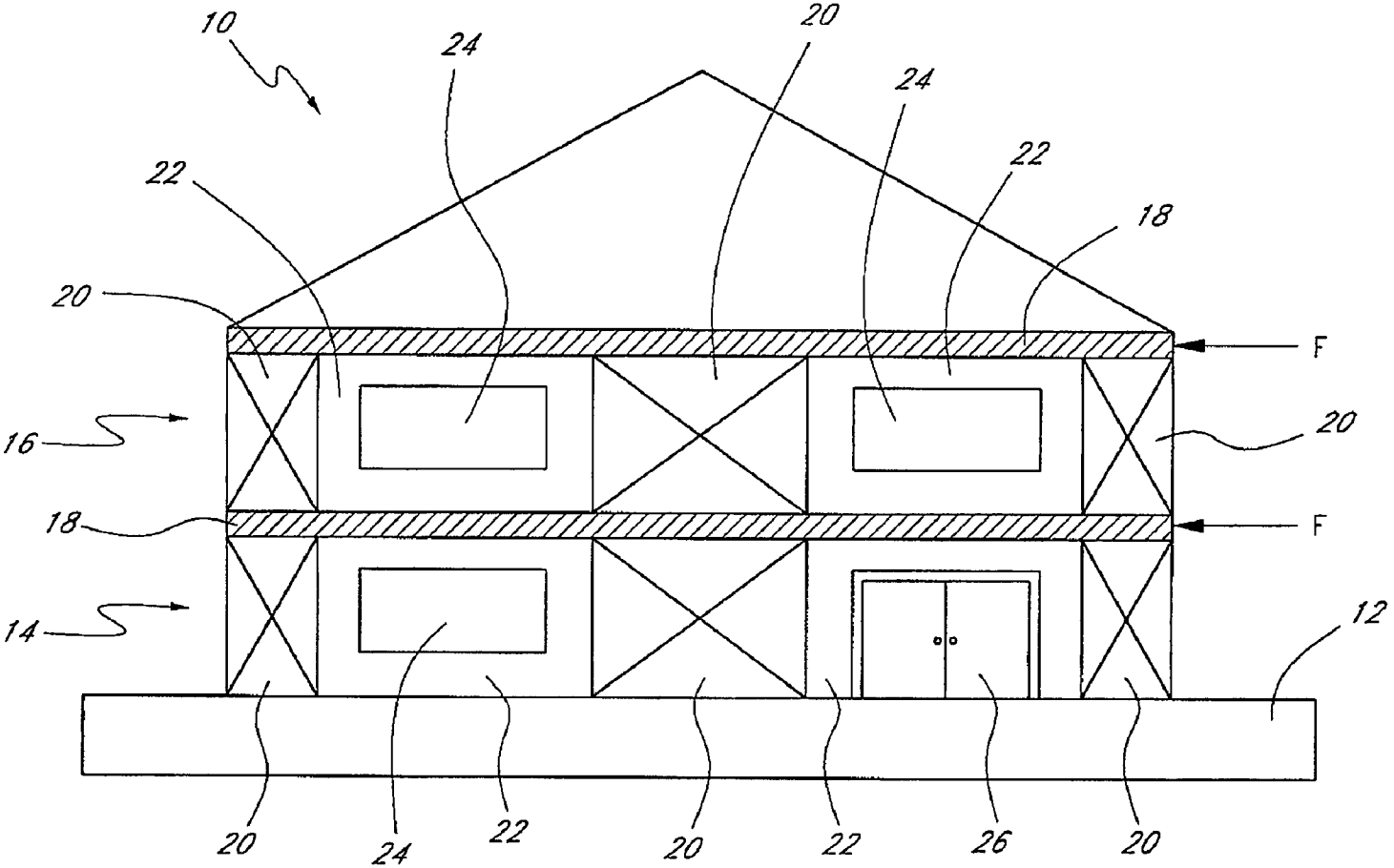
FIG. 1 (PRIOR ART)
FIG. 1 is a side view of a building having a conventional construction.

FIGS. 2-11 depict lateral load-resisting frame structures suitable for doors, windows, and other types of wall openings. These frame structures utilize plates for strengthening the connections between frame members. These frame structures also utilize internal web members for increasing the total rigidity and load transfer of each frame structure. Hence, the lateral load-resisting frame structures for wall openings of the present invention are herein referred to as "truss frames." The truss frames of the invention are capable of serving as the primary lateral load-resisting means of a wall. In other words, the use of these truss frames can reduce and even eliminate the need for conventional shear walls, such as the shear walls 20 of FIG. 1. It is believed that the truss frames of the present invention are also easier to assemble and transfer greater lateral loads than conventional shear walls.

Figure 2:
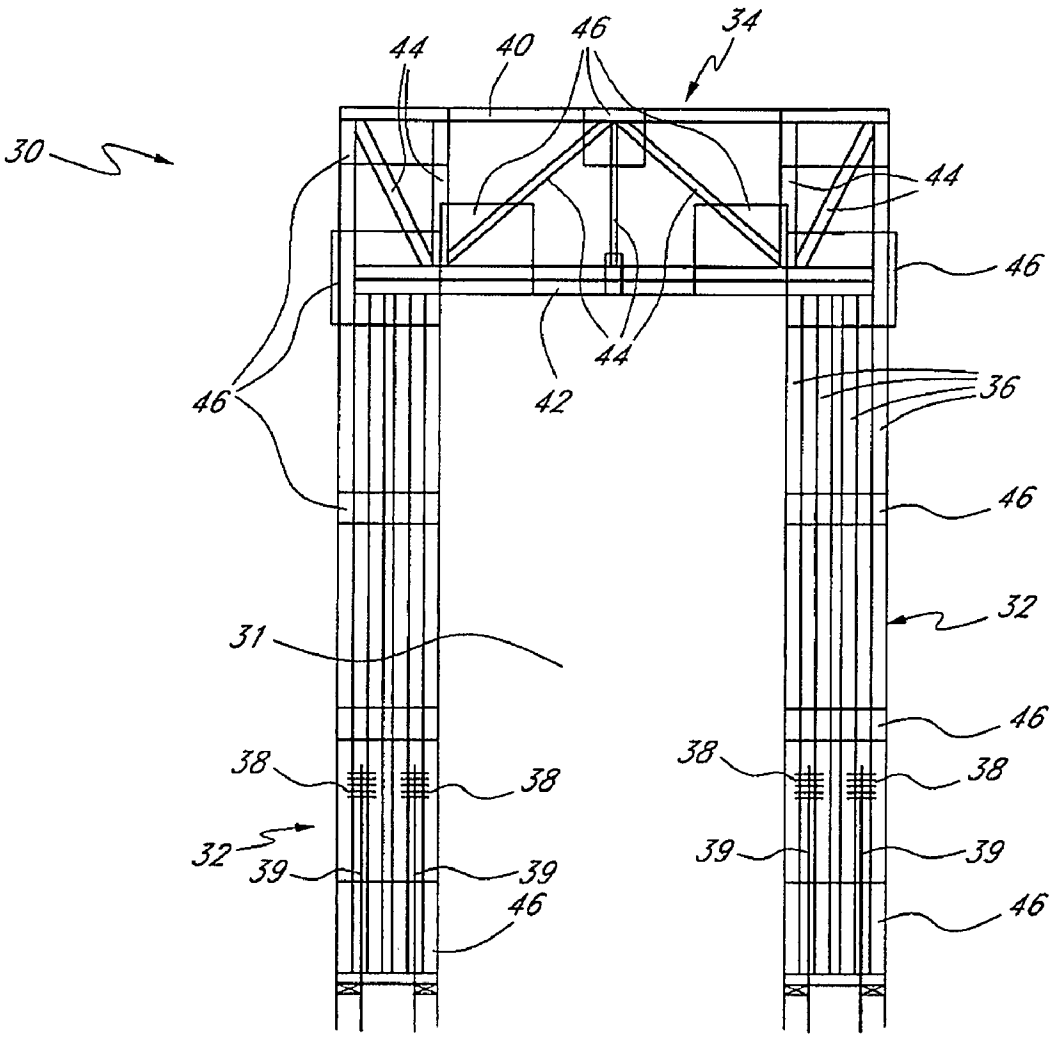
FIG. 2 is a side view of a truss frame for a door, according to one embodiment of the invention.

FIG. 2 illustrates a truss frame 30 for a door, according to one embodiment of the invention. The illustrated truss frame comprises two vertical columns 32 and a truss header 34 atop the columns 32. The columns 32 and header 34 define an opening 31 for a door or walkway. It will also be understood that additional non load-bearing members can be provided within the columns 32 and beneath the header 34 for defining the opening 31. Such additional non load-bearing members can define openings of different shapes, including non-rectangular openings. This is generally true for all of the door openings described below as well.

Each column 32 includes a plurality of vertical studs 36. In one embodiment, the studs 36 and other frame members comprise nominally 2×4 members (which are actually 1.5×3.5 inches in cross-section). Many other cross-sectional dimensions are possible for the studs 36 and other frame members, such as 4×4, 3×6, 6×6, etc. In the illustrated embodiment, the members are oriented so as to have a depth (the dimension leading out of the page) of 3.5 inches. In the illustrated embodiment, each column 32 includes four vertical studs 36, or two pairs of studs. In each column 32, the first and second studs 32 are secured together and to a structural element below the truss frame 30 via a holdown 38. Similarly, the third and fourth studs 32 are also secured together and to the lower structural element by another holdown 38. While any of a variety of different types of holdowns can be used, the holdowns 38 are preferably one of the types disclosed in the '042 and '767 patents. Thus, the holdowns preferably include vertical rods 39 that extend into a structural element below the truss frame, such as a building foundation. Each side-by-side pair of studs 36 configured to be secured together by a holdown 38 is referred to herein as a "sandwich post." While the illustrated columns 32 include two sandwich posts, they could alternatively include only one or even more than two sandwich posts. Also, the vertical positions of the channel-defining members 38 (see, e.g., the '767 patent) can vary, so long as the tie members of the holdowns extend downward to a structural element below the truss frame 30 (e.g., a building foundation or a horizontal load-bearing plate of a lower wall). The truss frame 30 can be prefabricated without the holdowns 38, which will ordinarily be secured on site during building assembly and construction.

With continued reference to FIG. 2, the truss header 34 comprises an upper horizontal chord 40 and a lower horizontal chord 42 (comprising two flush members). Either or both of the upper horizontal chord 40 or the lower horizontal chord 42 can be constructed as one or more wood members. The frame of the truss header 34 is partially defined by the outer vertical studs 36 at each end of the truss frame 30. In particular, each outer stud 36 extends upward to the upper chord 40 of the header 34. This particular construction provides for more efficient transmission of shear loads within the wall down to the structural element below the truss frame 30 (e.g., the building foundation). Inside of the chords 40, 42 and the outer studs 36, the header 34 includes a plurality of web members 44 forming a truss configuration. The illustrated truss header 34 includes three vertical web members 44 and four diagonal web members 44 positioned between the vertical web members and the studs 36. Skilled artisans will understand that web members 44 can be configured alternatively and will appreciate that the illustrated truss configuration is stronger and has greater utility than prior art wall opening frames. More importantly, the truss frame 30, as mentioned above, is capable of being a primary lateral load-resisting segment of a wall.

Still referring to FIG. 2, the truss frame 30 preferably includes a plurality of truss plates 46 for reinforcement. For clarity, FIG. 2 (as well as the following figures) shows only the outlines of the truss plates 46. In a preferred embodiment, the truss plates 46 comprise metal plates with holes punched out of them. The punched holes form teeth or protrusions on the side opposite to that from which the holes are punched. Preferably, the punching process comprises punching the holes individually with an elongated punching element and then twisting the punching element to form a slight angularity to the teeth. The teeth formed by the punching process facilitate connection of the truss plates 46 to the wooden frame members of the truss frame 30, including the studs 36, chords 40, and web members 44. The '176 patent illustrates an exemplary method of forming teeth in a truss plate. Skilled artisans will also understand that the truss plates can be secured to the truss frame 30 by other means, such as screws, nuts and bolts, etc. Preferably, the truss plates 46 are provided in pairs at each location at which the plates 46 are attached, so that there is one truss plate on each side of the truss frame 30. The truss plates 46 are preferably applied to the truss frame 30 by pressure, such as by a large roller.

The illustrated truss frame 30 of FIG. 2 comprises one of many possible embodiments of truss frames of the invention. Those of ordinary skill in the art will understand that a truss frame of the invention can include different numbers, sizes, orientations, and configurations of the vertical studs 36, chords 40 and 42, web members 44, holdowns 38, and truss plates 46. It will further be appreciated that the truss frames of the invention can be used for many different types of wall openings. By way of illustration, FIGS. 3-13 depict truss frames according to a number of alternative designs and embodiments of the invention.

Figure 3:
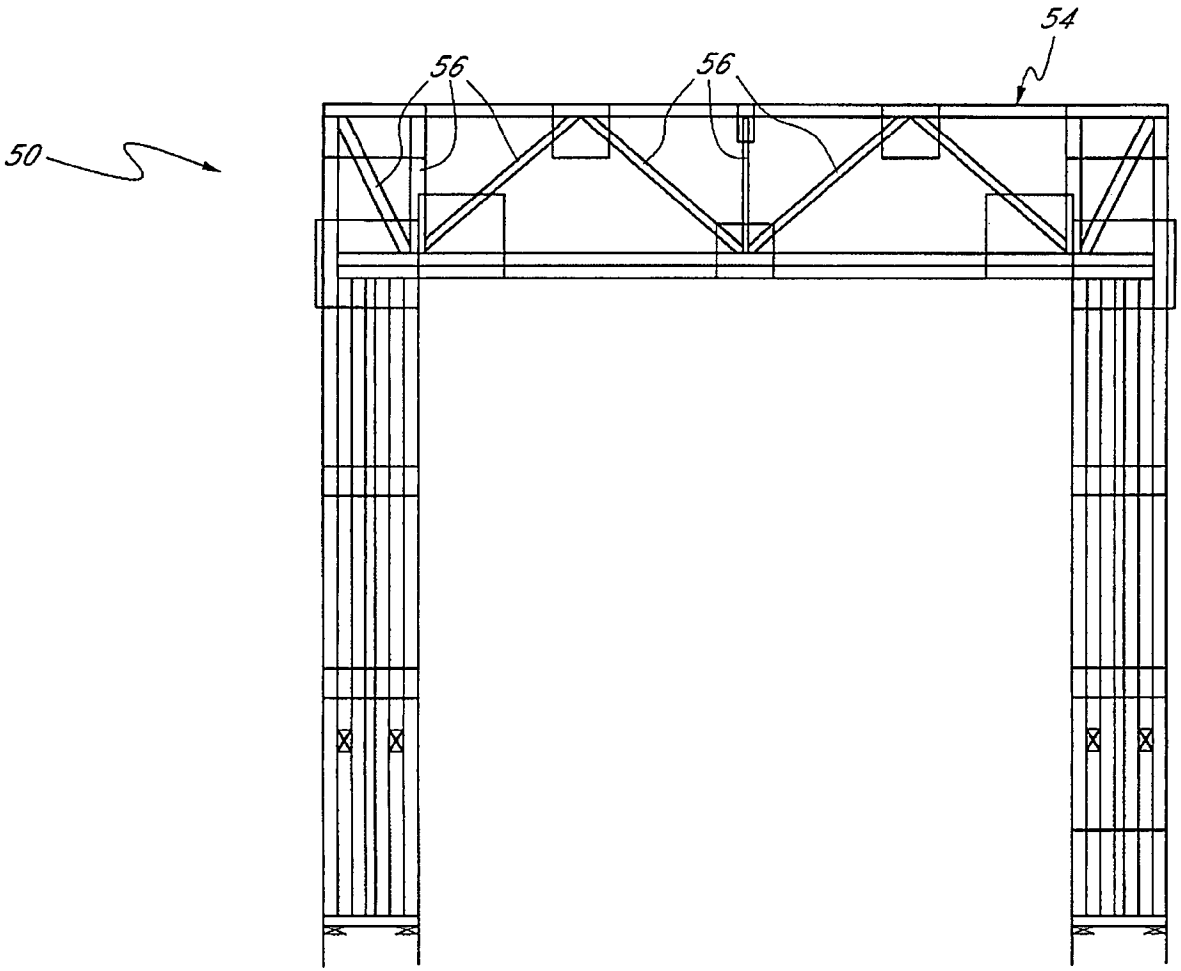
FIG. 3 is a side view of a truss frame for a door, according to another embodiment of the invention.

FIG. 3 shows a truss frame 50 for a door. The truss frame 50 is similar in most aspects to the truss frame 30 shown in FIG. 2 and described above. The difference is that the truss frame 50 has a longer truss header 54 and is thus designed for larger doors, or perhaps double doors. Since the truss header 54 is longer than the previous embodiment, there are more web members 56. In particular, the truss 54 includes six diagonal web members and three vertical web members. In FIG. 3 and many of the following figures, each holdown is graphically denoted by a vertically elongated "X" within a box interposed between two vertical studs.

Figure 4:
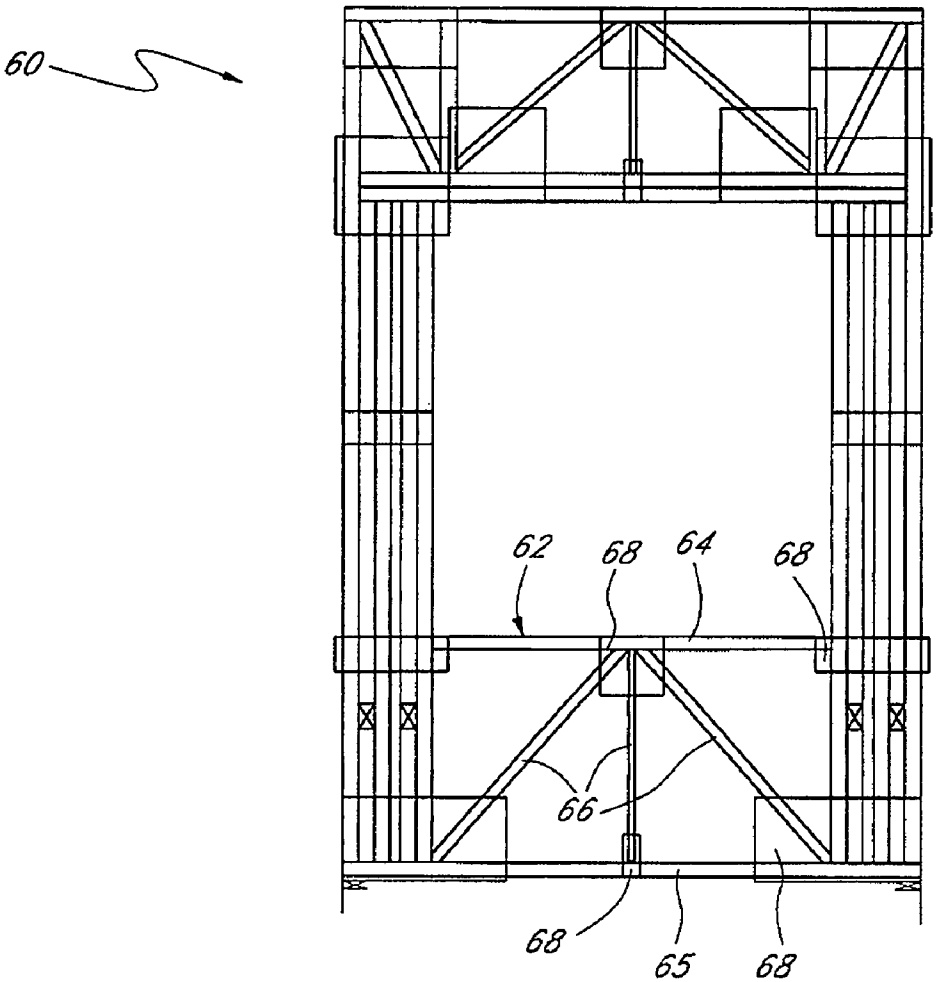
FIG. 4 is a side view of a truss frame for a window, according to one embodiment of the invention.

FIG. 4 shows a truss frame 60 for a window. The truss frame 60 is similar to those described above with the exception that it includes a "sill truss" 62 below the window opening. The sill truss 62 includes an upper chord 64 and is defined below by a base chord 65. The sill truss 62 also includes internal web members 66 and truss plates 68 for added strength and rigidity. The outer truss plates 68 extend across the two sandwich posts of the truss frame 60. It will also be understood that additional non load-bearing members can be provided within the columns, below the header, and above the sill truss 62 for defining the window opening. Such additional non load-bearing members can define openings of different shapes, including non-rectangular openings. This is generally true for all of the window openings described below as well.

Figure 5:
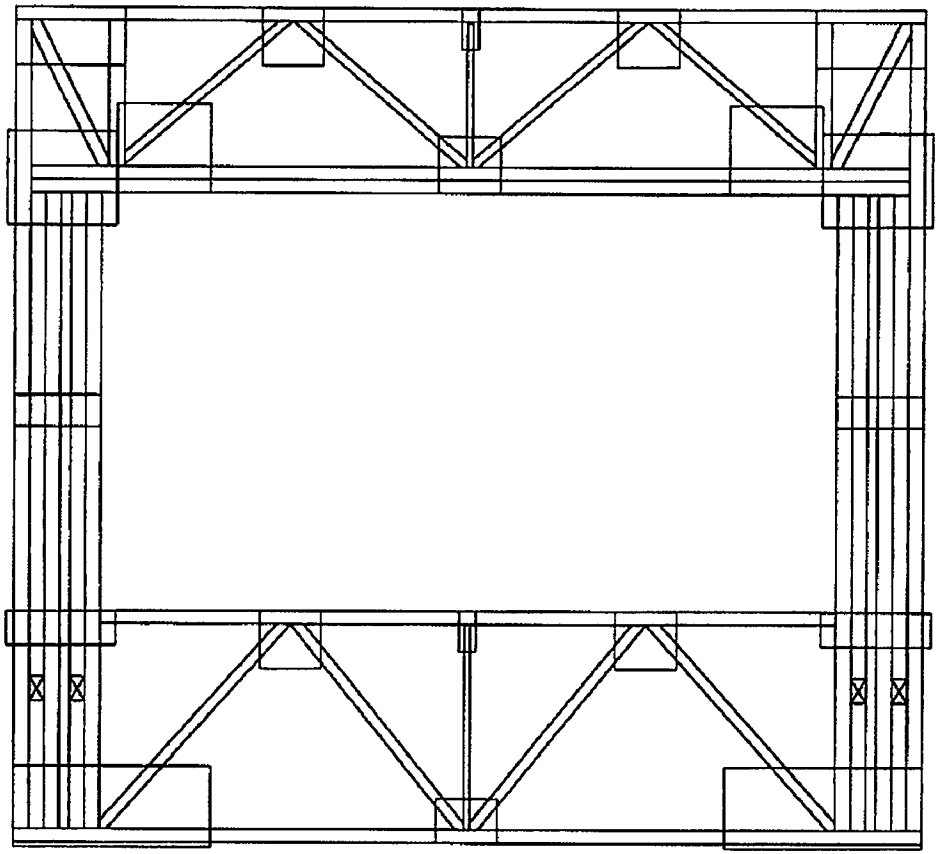
FIG. 5 is a side view of a truss frame for a window, according to another embodiment of the invention.

FIG. 5 shows a truss frame 70 for a larger window than that of the truss frame 60 of FIG. 4. The chief difference between the two truss frames is that the truss frame 70 includes a longer truss header and a longer sill truss. Since they are longer, they include more web members.

Figure 6:
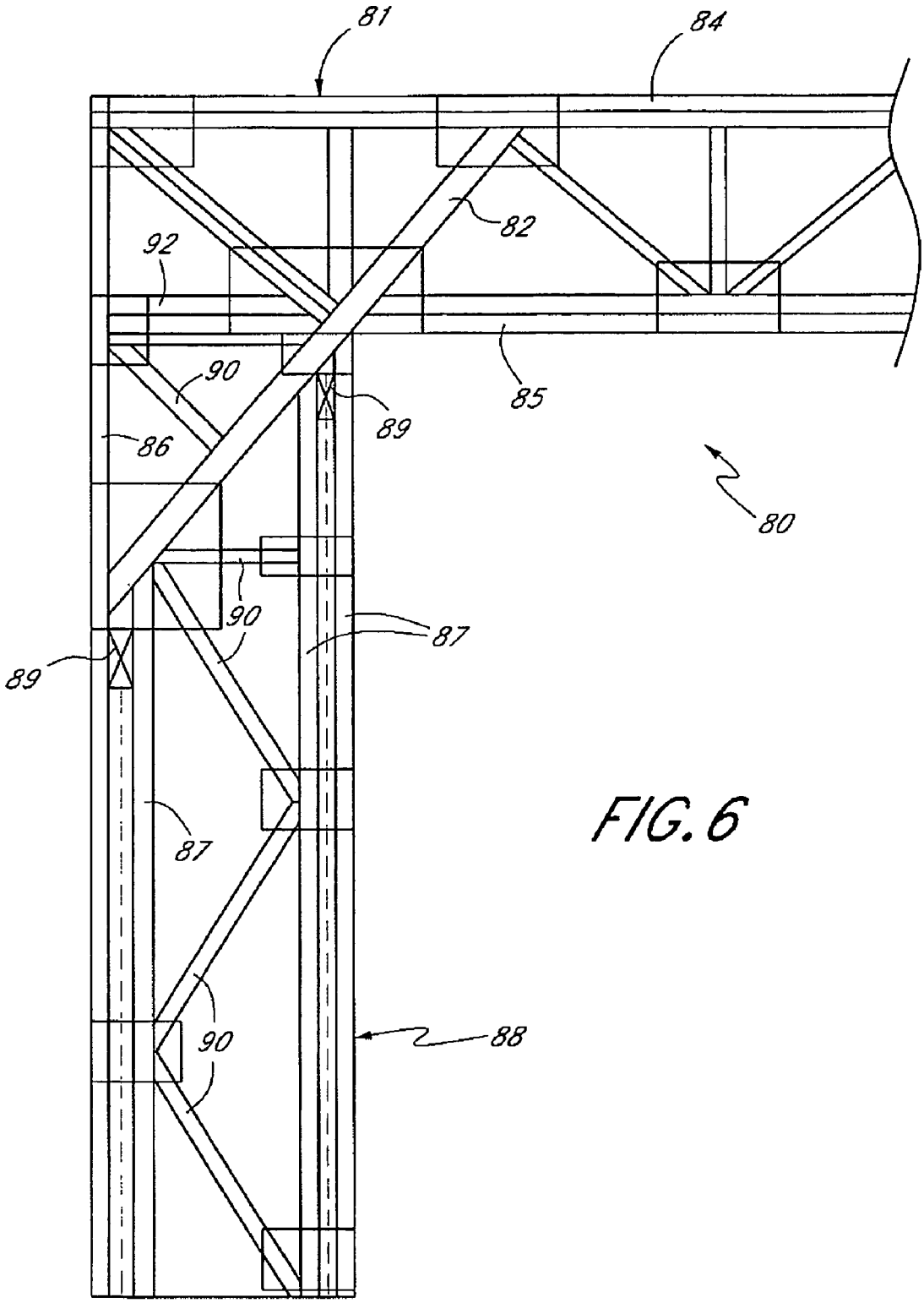
FIG. 6 is a side view of a portion of a truss frame for a wall opening, according to another embodiment of the invention.

FIG. 6 shows a portion of a truss frame 80 having an alternative design. The truss frame 80 includes a diagonal web member 82 extending from the upper chord 84 of the truss header 81 down to the outer vertical stud 86 of the outer sandwich post of the column 88. The remaining vertical studs 87 of the column 88 terminate at their upper ends at the diagonal web member 82. In this configuration, the truss header 81 includes lower chord portions 85 and 92 that also terminate at the web member 82. The truss frame 80 includes a second diagonal web member (not shown) similar to web member 82 at the opposite end of the truss header 81, for connection to the other column 88. The diagonal web members 82 are believed to transmit loads more efficiently to the columns 88 of the truss frame 80. In addition, the columns 88 are configured differently than those described above. Specifically, the columns 88 include internal web members 90 for added strength. Holdowns 89 are preferably also provided.

Figure 7:
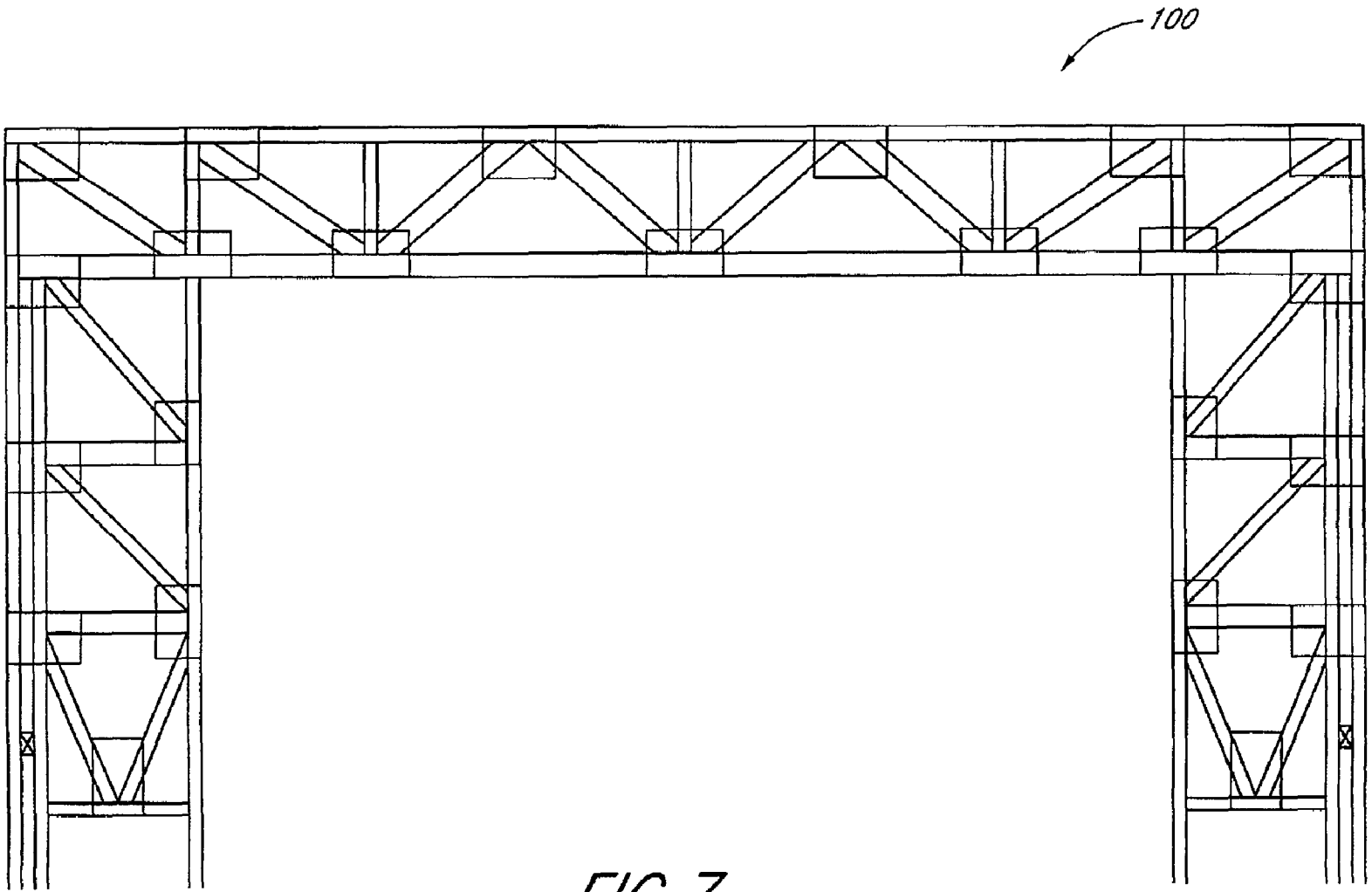
FIG. 7 is a side view of a truss frame for a door, according to another embodiment of the invention.

FIG. 7 shows a truss frame 100 for a large door, according to another embodiment of the invention. The truss frame 100 includes only one sandwich post in each column. Further, the columns include diagonal web members.

Figure 8:
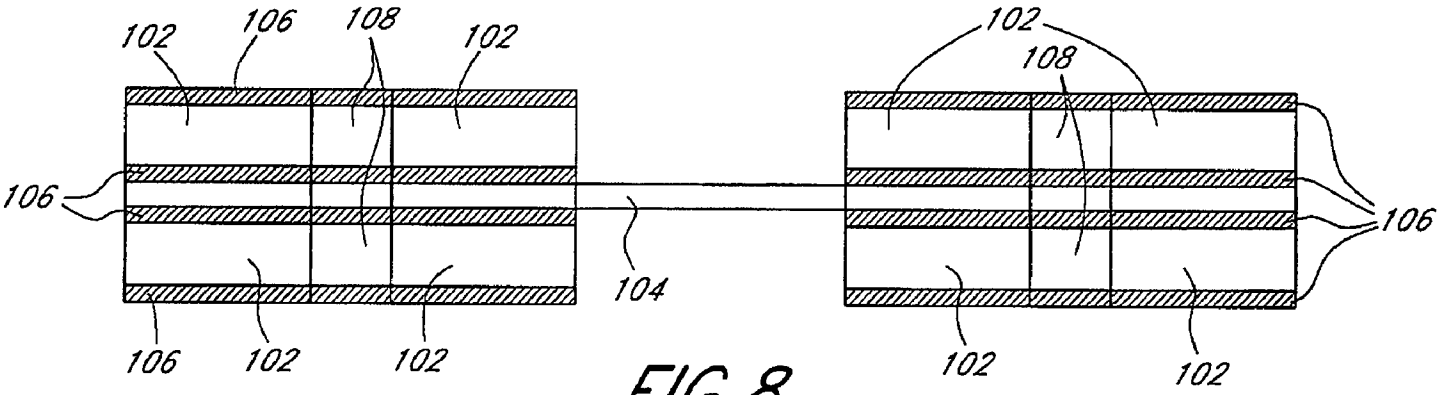
FIG. 8 is a horizontal cross-sectional view of a column of a truss frame for a wall opening, according to another embodiment of the invention.

FIG. 8 is a horizontal cross-section of a single column (such as the column 32 of FIG. 2) of a truss frame. FIG. 8 illustrates an alternative truss frame configuration, in which the frame members are oriented differently. In this context, "frame members" are the vertical studs of the columns, the upper and lower chords of the truss headers and sill trusses, and the internal web members. As mentioned above, the frame members (preferably nominally 2×4 inch dimensions, which are actually 1.5×3.5 inches) of the above-described embodiments (FIGS. 2-7) are oriented so that their longer dimension (e.g. 3.5 inches) extends depth-wise, i.e. out of the page. In the embodiment of FIG. 8, the longer dimensions of the frame members extend width-wise, i.e., horizontally. It is believed that this configuration will provide greater strength and lateral load-resisting capacity, particularly for shear forces.

The column depicted in FIG. 8 includes eight vertical studs 102 and a single piece of plywood 104. It also includes a plurality of truss plates 106. It will be understood that the particular cross-section shown is at a vertical position in which truss plates 106 are employed, but the truss plates 106 preferably do not extend vertically along the entire lengths of the studs 102. As shown, each side of the column includes four studs 102 in two pairs. Each pair of studs 102 is separated by a space 108 and, at the illustrated cross-section, sandwiched between two truss plates 106. On each side of the column, the two pairs of studs 102 are positioned on opposite sides of the plywood 104, which extends horizontally and vertically throughout the column. In the preferred embodiment, holdowns are utilized within the spaces 108. Depending on the holdown design, the holdowns may extend beyond the spaces 108. In one embodiment, the plywood 104 does not extend downward as far as the studs 102, leaving a single space (where the two spaces 108 are joined) for the holdown. It will be appreciated that the holdown design may be different than those disclosed in the '042 and '767 patents. In an alternative embodiment, the truss plates 106 are omitted from the design. In another embodiment, the plywood 104 is omitted from the design. It will be appreciated that many of the embodiments of the present invention (including the truss panels and truss walls, described below) can benefit from reorienting the frame members in the manner shown in FIG. 8.

Figure 9:
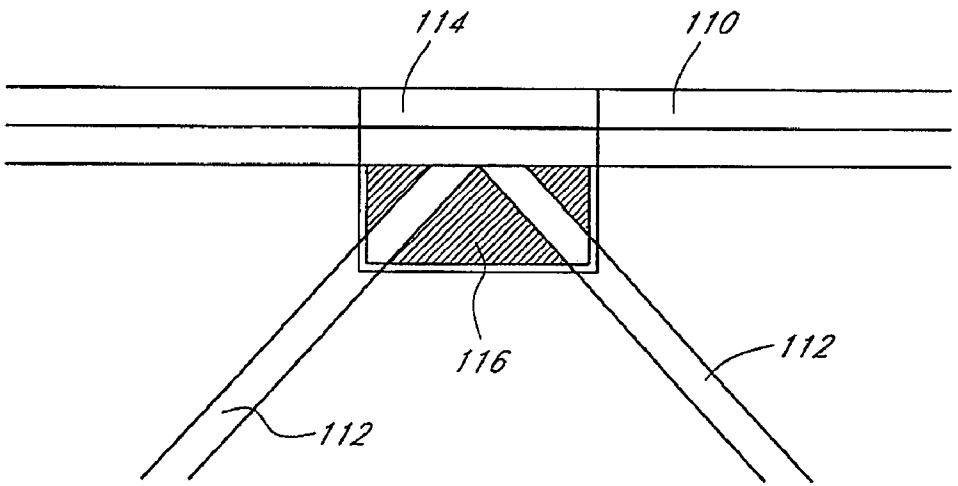
FIG. 9 is a side view of a portion of truss frame for a wall opening, illustrating a method of reinforcing the connection of the web members to the outer frame members, according to one embodiment of the invention.

FIG. 9 illustrates a method and configuration for strengthening the connections of the web members to the other frame members. FIG. 9 shows a portion of a truss header including an upper chord 110 (comprising two wood members flush together), web members 112, and a pair of truss plates 114. As described above, the truss plates 114 sandwich the truss header and reinforce the connections of the web members 112 to the upper chord 110.

With reference to FIG. 9, further reinforcement can be provided by blocking material 116 (shown cross-hatched) positioned and snugly fitting within the intersections between the web members 112 and the upper chord 110. Preferably, the blocking material 116 comprises wood, but a variety of other materials are suitable. The blocking material 116 can be attached to the frame members only by the truss plate or by any other suitable means, including adhesives and epoxies, nailing, etc. In the illustrated embodiment, the outer dimensions of the blocking material 116 are somewhat recessed from the perimeter of the truss plates 114. In other embodiments, the perimeters of the blocking material 116 and the truss plates 114 are coextensive. In still other embodiments, the blocking material 116 extends beyond the truss plates 114. It will be appreciated that such blocking material 116 can be used at any intersection of web members 112 with vertical studs, chords, or other frame members. Further, blocking material 116 can be used at intersections of frame members other than diagonal web members.

An alternative type of reinforcement for the connection of web members to other frame members is to strengthen the truss plates. For example, with reference to FIG. 9, this alternative method involves removing the blocking material 16. Instead the truss plates 114 are strengthened at these unblocked areas to add plate rigidity. Truss plate strengthening can comprise the elimination of punched teeth in these unblocked areas and the addition of ribs or other plate strengtheners. It will be appreciated that reinforced truss plates 114 can be used at any intersection of web members 112 with vertical studs, chords, or other frame members. Further, the reinforced truss plates 114 can be used at intersections of frame members other than diagonal web members. In yet another embodiment (not shown), the blocking material 116 of FIG. 9 is combined with reinforced truss plates 114 as herein described, to provide even greater reinforcement.

In the illustrated embodiments of truss frames, the headers of the frames are shown as trusses (hence the term "truss header"). It will be appreciated that the truss headers could be replaced with a solid piece of wood, which is stronger. The headers can also comprise manufactured wood such as a glu-lam beam, a parallam, MicroLam, or any wood-like product that can be used as a beam.

Figure 10:
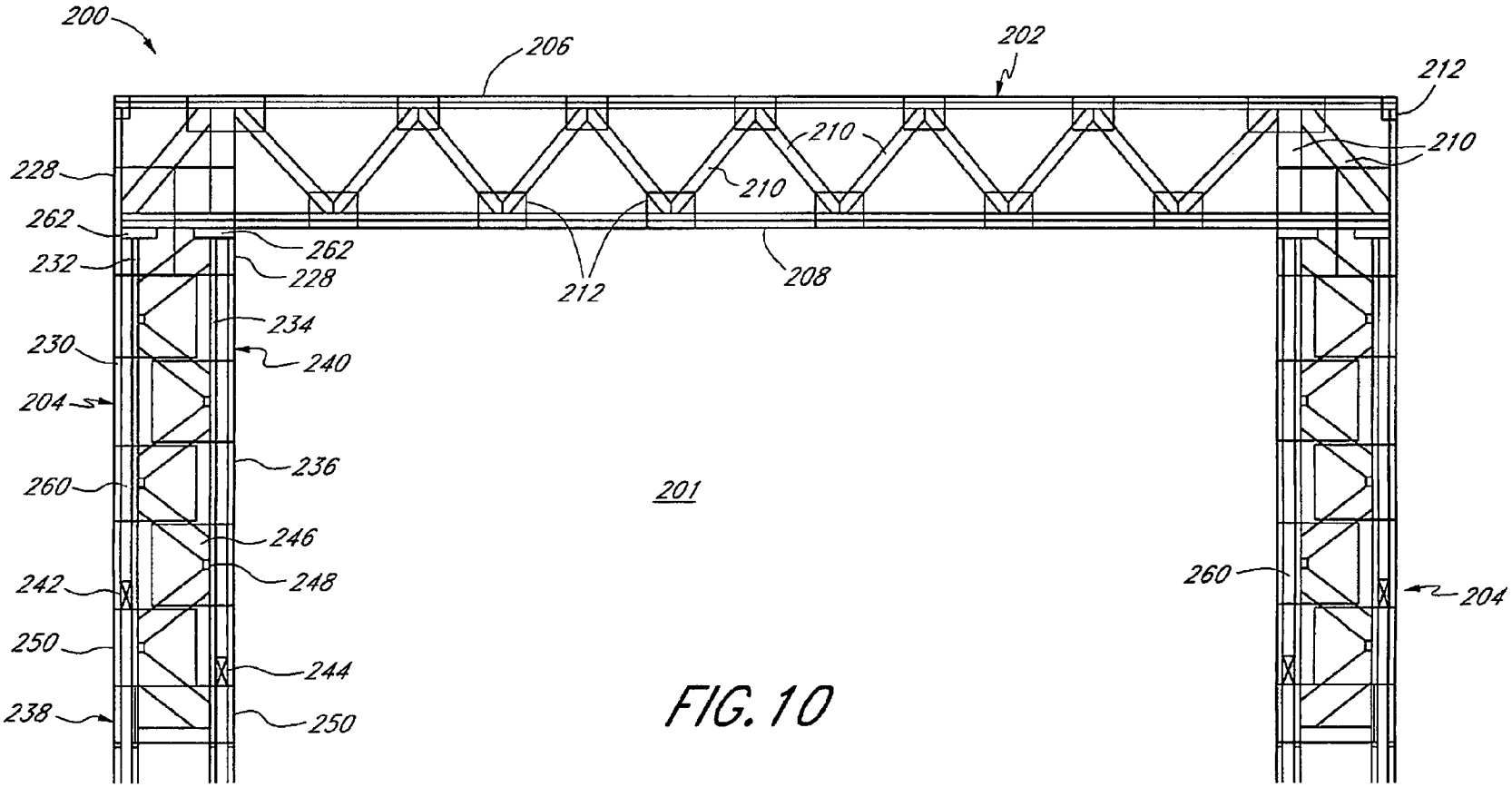
FIG. 10 is a side view of truss frame for a door, according to another embodiment of the invention.

FIG. 10 shows a truss frame 200 for a door opening 201, according to another embodiment of the invention. The truss frame 200 comprises a header 202 and columns 204. The illustrated header 202 is a truss header comprising an upper horizontal chord 206, a lower horizontal chord 208 spaced below the upper chord 206, a set of header web members 210 extending between the upper and lower chords 206, 208, and a plurality of header truss plates 212. In the illustrated embodiment, each of the chords 206, 208 comprises a pair of horizontal beams flush against one another. This permits the use of standard sized beams (e.g., nominally 2×4 beams). It will be understood that solid beams can be used instead of the illustrated pairs of beams. The lower chord 208 defines an upper end of a wall opening 201 for a door or double-doors. The ends of the web members 210 are preferably positioned to transmit loads to others of the web members 210. Preferably, the web members 210 are directly in contact with one another or in contact with intervening members through which loads can be transmitted from one web member to another web member. Preferably, each of the truss plates 212 is positioned to secure connections of some of the web members 210 to one of the upper and lower chords 206, 208. As in previously described embodiments, the truss plates 212 are preferably provided in pairs, so that the plates 212 of each such pair are positioned on opposite sides of the truss frame 200 at about the same vertical and horizontal location. The web members 210 and the truss plates 212 are configured to share loads transmitted within the upper and lower chords 206, 208.

Figure 10B:
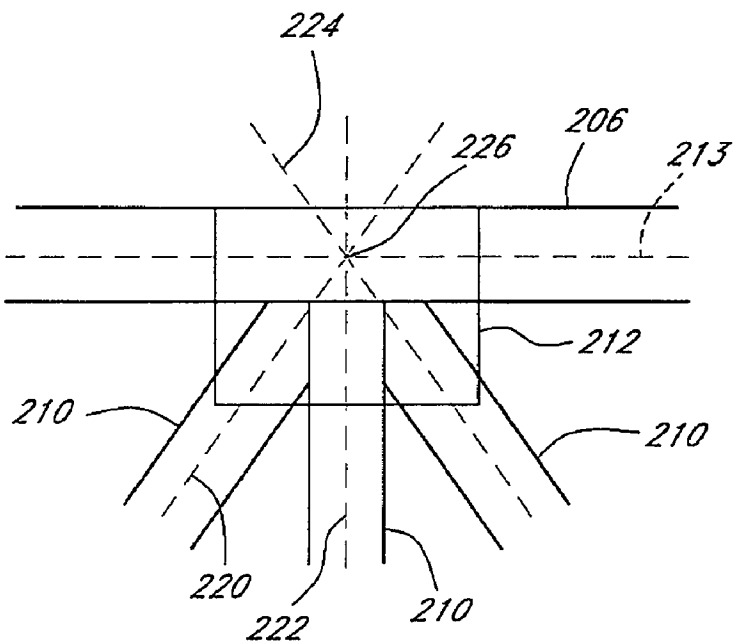
FIGS. 10A and 10B are exploded views of truss plates of the header of the truss frame of FIG. 10.
Figure 10A:
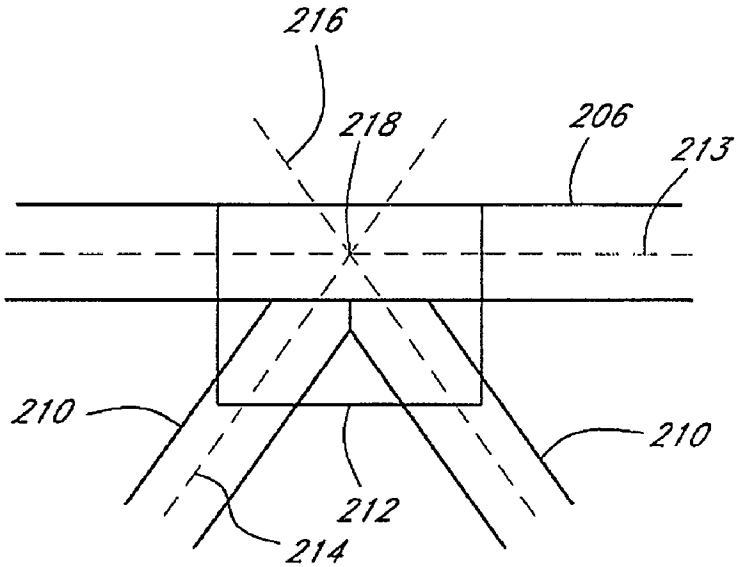

FIGS. 10A and 10B illustrate a preferred configuration of the truss header 202. As explained above, the truss plates 212 share loads transmitted through the chords 206, 208 and the web members 210. A common failure mode of the truss plates 212 is shearing or tearing caused by various load paths experienced by each plate. While increasing the thickness of the truss plate 212 reduces this failure risk, it also adds to the wall thickness and cost. Another method to reduce this risk of failure is to configure the truss header 202 so that there is one single point of intersection of the load paths defined by the web members 210 and the chord 206, 208 upon which a given truss plate 212 is secured.

For example, FIG. 10A shows a truss plate 212 secured to the upper chord 206 at a connection point of two diagonal web members 210. In this embodiment, the chord 206 comprises a single horizontal beam. However, it could alternatively comprise two flush beams as in FIG. 10. In FIG. 10A, the chord 206 defines a horizontal load path 213, which will most likely be at or near the center of the chord 206. If two identical flush beams are used for the chord 206 (as in FIG. 10), the load path defined by the chord 206 would probably lie along the interface between the two beams. The diagonal web members 210 define load paths 214 and 216, which will most likely be at or near the centerlines of the web members. Preferably, for reduced tendency of the truss plate 212 to tear, the load paths 213, 214, and 216 all intersect at a single point 218.

FIG. 10B shows a truss plate 212 secured to the upper chord 206 at a connection point of two diagonal web members 210 and one vertical web member 210, as shown on the ends of the truss header 202 of FIG. 10. The chord 206 defines a load path 213. The diagonal web members 210 define load paths 220 and 224, and the vertical web member 210 defines a load path 222. Preferably, for reduced tendency of the truss plate 212 to tear, the load paths 213, 220, 222, and 224 all intersect at a single point 226.

Preferably, each of the columns 204 is substantially identical, except for having an inverted configuration so as to preserve symmetry about a vertical center axis of the truss frame 200. In the embodiment shown in FIG. 10, each of the columns 204 comprises two sandwich posts. For example, the column 204 on the left side of FIG. 10 includes an outer sandwich post 238 and an inner sandwich post 240. The outer sandwich post 238 comprises vertical studs 230 and 232 sandwiching a holdown 242 (denoted by a vertically elongated "X"). The inner sandwich post 240 comprises vertical studs 234 and 236 sandwiching a holdown 244 (also denoted by a vertically elongated "X"). It will be understood that FIG. 10 is not necessarily drawn to scale, and the studs 230, 232, 234, and 236 may be somewhat wider than shown. The holdowns 242 and 244 are secured to, and therefore serve to prevent the truss frame 200 from moving upward relative to, a structural element below the wall within which the truss frame 200 is located, such as a building foundation or a structural member of a lower floor of the building. A plurality of diagonal column web members 246 is provided between the two sandwich posts 238 and 240. Preferably, each web member 246 extends from the stud 232 to the stud 234 and has at least one end positioned to transmit loads to another of the web members 246. In the illustrated embodiment, small beam-separation blocks 248 (or "web-spacer blocks) are interposed between the ends of the web members 246, each block 248 bearing against one of the studs 232 and 234. While the beam-separation blocks 248 are desirable for reasons explained below, it will be understood that the blocks 248 could be omitted from the design. The stud 230 extends vertically upward to the upper chord 206 of the truss header 202, providing a more integrated connection of the column 204 and the truss header. This allows for better transmission of shear from the truss header 202 into the columns 204.

While any of a variety of different types of holdowns can be used, the holdowns 242 and 244 are preferably one of the types disclosed in the '042 and '767 patents. A preferred holdown design is commercially available from Trussed, Inc. of Perris, Calif. under the trade name "Tension Tie" or "T2". This type of holdown comprises a rigid member and a tie member. The rigid member is preferably a channel-defining member configured to be secured laterally to a vertical stud (in the illustrated design it is secured laterally to two studs). The tie member (preferably a threaded rod with a diameter between 0.5-1.0 inches, and more preferably about 0.75 inches) has a lower end configured to be secured to a structural member below the wall (such as a building foundation or a structural member of a lower floor of the building) and an upper end secured to the channel-defining member so that the channel-defining member is prevented from moving upward with respect to the tie member.

Figure 10D:
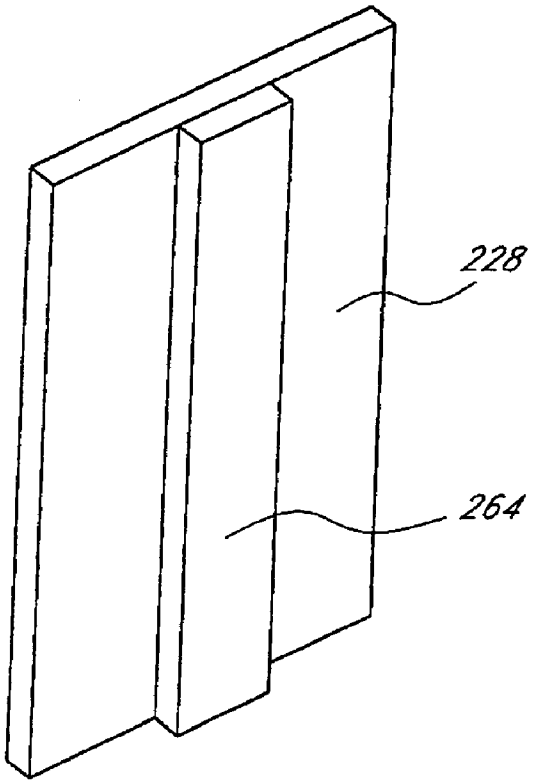
FIG. 10D is a perspective view of a reinforced truss plate of the truss frame of FIG. 10.
Figure 10C:
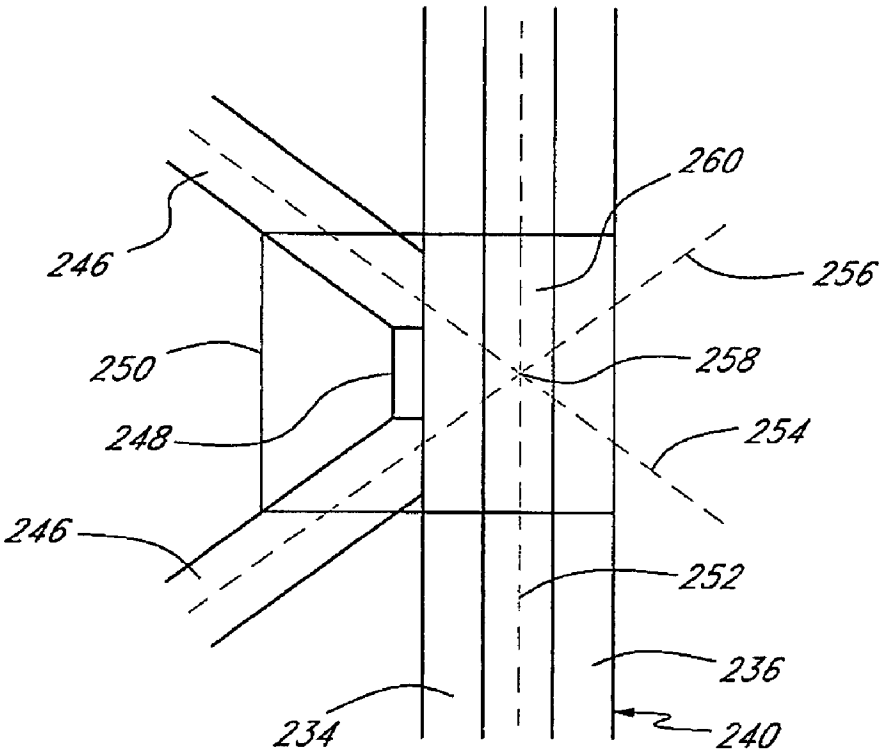
FIG. 10C is an exploded view of a column of the truss frame of FIG. 10.

The connections of the web members 246, beam-separation blocks 248, and posts 238 and 240 are secured by pairs of column truss plates 250. As explained above with respect to the header truss plates 212, one failure mode of the column truss plates 250 is tearing or shearing due to the combination of loads experienced by each plate 250. When a shear load is experienced within the truss frame 200, the column truss plates 250 experience loads transmitted within the column web members 246 and the posts 238 and 240. While this risk of failure can be reduced by increasing the thickness of the truss plates 250, that would increase wall thickness and cost. The beam-separation blocks 248 help to reduce this risk of failure by spacing apart the ends of adjacent web members 246. For example, FIG. 10C shows a pair of truss plates 250 secured on opposite sides of the sandwich post 240 and two of the web members 246. The sandwich post 240 defines a load path 252 that is essentially the centerline between the studs 234 and 236. When the holdown 244 (FIG. 10) is the type disclosed in the '042 or '767 patents, or a "Tension Tie" or "T2" sold by Trussed, Inc., the load path 252 is essentially collinear with the tie member or threaded rod of the holdown. The web members 246 define load paths 254 and 256. In order to reduce the tendency of the truss plates 250 to tear, the load paths 252, 254, and 256 preferably all intersect at a single point 258. In order to accomplish this, the beam-separation blocks 248 provide some vertical separation between the ends of the web members 246. If the blocks 248 were not present, the intersection point of the load paths 254 and 256 would be to the left of the load path 252. In the illustrated embodiment, each block 248 has upper, lower, and lateral bearing surfaces that respectively bear against a lower bearing surface of a lower end of the web member 246 above the block 248, a lateral surface of one of the posts 238, 240, and an upper bearing surface of an upper end of the web member 246 below the block 248. While the illustrated embodiment utilizes beam-separation blocks 248 to align the intersection point 258 of the load paths 254 and 256 along the load path 252, it will be understood that the blocks 248 could be omitted while maintaining said alignment.

In order to further reduce the risk of failure of the truss plates 250, vertically oriented plate-support blocks 260 are preferably provided between the studs of each sandwich post at about the same vertical levels of the beam-separation blocks 248. The blocks 260 achieve this goal by increasing the surface area of engagement of the truss plates 250. With reference again to FIG. 10C, an exemplary block 260 is shown interposed between the studs 234 and 236. Preferably, the width of the block 260 is about the same as the spacing between the studs 234 and 236, and the vertical length of the block 260 is about the same as the vertical dimension of the pair of truss plates 250. Since the primary purpose of the block 260 is to increase the surface area of engagement of the truss plates 250 to the truss frame 200, it is not necessary for the block 260 to extend vertically beyond the edges of the truss plates 250. With reference to FIG. 10, some of the plate-support blocks 260 are located below the holdowns 242, 244, in which case vertical boreholes must be drilled through such blocks 260 to allow for passage of a securing element of the holdown (such as the tie member of the holdown described in the '042 and '767 patents). In one embodiment, the hole drilled through the block 260 does not exceed about 40% of the thickness of the block.

With reference to FIG. 10, the illustrated truss frame 200 includes pairs of connection truss plates 228 that strengthen the connection between the header 202 and the columns 204. The connection truss plates 228 are preferably larger than the other truss plates, particularly in their vertical dimension. In the illustrated embodiment, each pair of truss plates 228 is positioned so that roughly half of each truss plate 228 is secured to the truss header 202 and the other half is secured to one of the columns 204. Preferably, each column 204 includes two pairs of truss plates 228, each pair secured to only one of the two posts 238 and 240. Preferably, the two pairs of truss plates 228 of the column 204 overlie substantially the entire distance between the two posts 238 and 240. It is advantageous to provide two pairs of truss plates 228 instead of one pair of larger truss plates that extend laterally across the entire column 204. This is because the load transmitted within the posts 238 and 240 tend to be in opposite directions. For example, when a leftward shear load is experienced at the upper right corner of the truss frame 200 of FIG. 10, the sandwich post 238 is in compression and the sandwich post 240 is in tension. If there was only a single pair of larger truss plates connecting the column 204 to the header 202, such larger truss plates would tend to shear along a vertical line roughly at their centers. Thus, providing two pairs of connection truss plates 228, one for each sandwich post, is more efficient and less prone to failure.

The connection truss plates 228 are subjected to complex loads, including moment forces transmitted between the header 202 and the columns 204. It has been observed that this set of loads can cause the truss plates 228 to shear or tear. Due to these moment forces, the risk of this mode of failure is present even if all of the compression and tension load paths through each plate 228 intersect at a single point. When the truss frame is under shear, the moment forces and linear loads experienced by the truss plates 228 result in a first net load in a first portion of the truss plate and a second net load in a second portion of the truss plate, the directions of the first and second net loads being generally opposite to one another. It has been observed that each plate 228 tends to shear along a straight generally vertical line or border that separates these first and second portions of the truss plate 228. With reference to FIG. 10D, this problem can be addressed by attaching a strip of material (or "band-aid") 264 to the connection truss plate 228, along the border between the first and second portions of the truss plate. The strip of material 264 provides increased resistance to tearing of the truss plate 228 along such border. The strip of material 264 can be attached to the truss plate 228 by a variety of methods, such as screws, teeth engagement with holes of the plate 228, etc. For example, the '176 patent illustrates a method of nesting two plates together by engaging the teeth of one plate with the punched holes of another plate. Preferably, band-aids 264 are provided to both plates of each pair of truss plates 228. In the illustrated embodiment, band-aids 264 are attached to each of the four pairs of connection truss plates 228.

With continued reference to FIG. 10, the truss frame 200 preferably includes horizontal compression plates 262 interposed between upper ends of the posts 238, 240 and lower surfaces of the header 202. In FIG. 10 the vertical dimension of the compression plates 262 is exaggerated for clarity. The compression plates 262 prevent "point-loading" of the posts 238, 240 against the lower surface of the header 202. In the illustrated embodiment, the compression plates 262 prevent point-loading of the upper ends of the studs 232, 234, and 236 into the bottom surface of the lower chord 208 of the truss header 202. If the lower chord 208 is wooden and the compression plates 262 are removed from the design, there would be an undesirable tendency of the studs 232, 234, and 236 to dig into the chord 208, which reduces the tightness and rigidity of the frame 200. The compression plates 262 serve to spread the load out over a larger area of the lower chord 208, which helps to maintain the rigidity of the frame 200. Skilled artisans will readily appreciate that compression plates can be used in any load-resisting segment of a building structure (e.g., segments in walls, roofs, ceilings, floors, etc.), wherever a first beam has an end secured against a side of a second beam. The compression plates preferably comprise metal or steel, but can also be formed of a variety of other materials, giving due consideration to the loads experienced in use.

Figure 11:
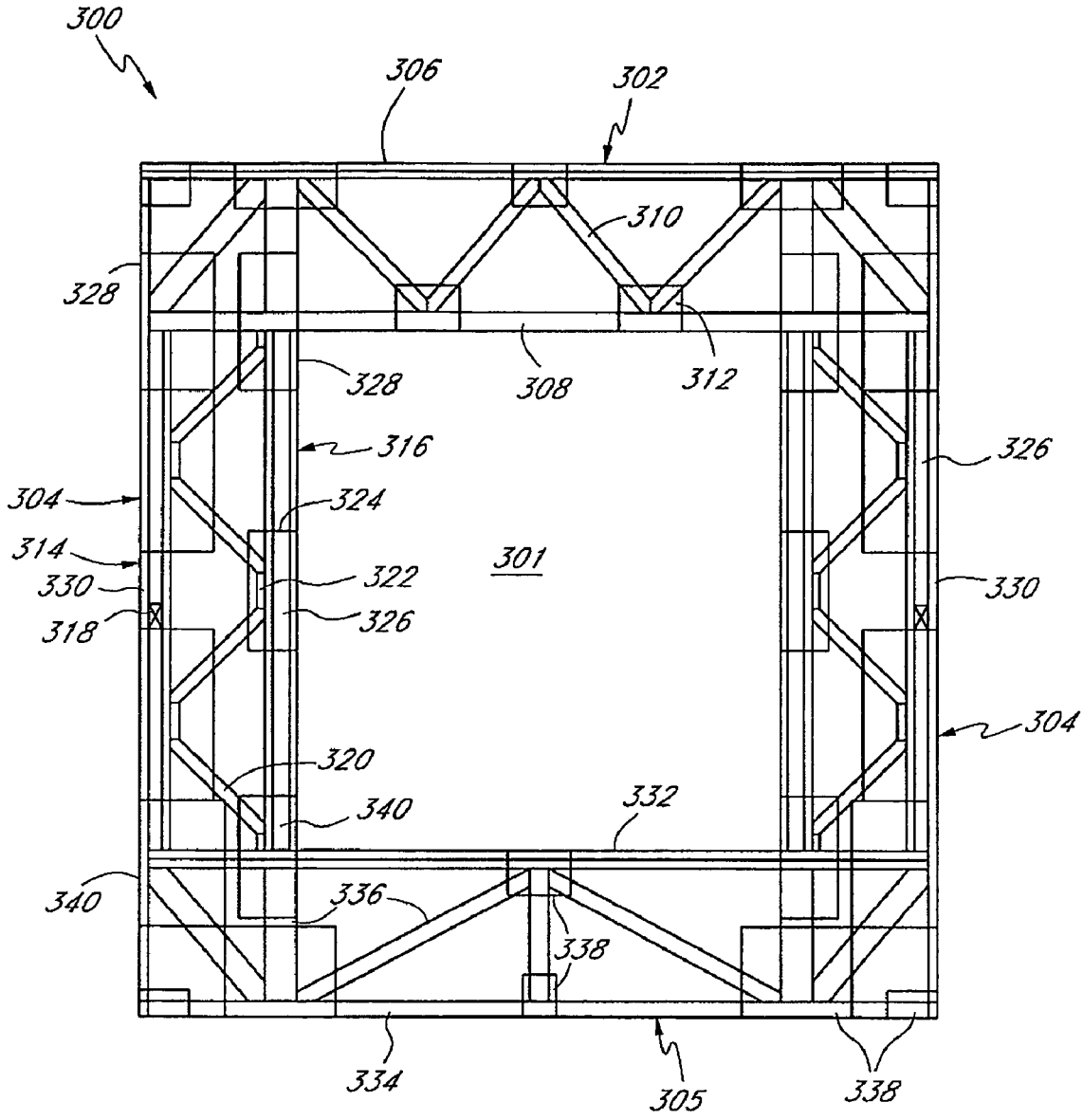
FIG. 11 is a side view of a truss frame for a window, according to another embodiment of the invention.

FIG. 11 shows a truss frame 300 for a window opening 301, according to another embodiment of the invention. The truss frame 300 comprises a header 302, columns 304, and a sill structure 305. The illustrated header 302 comprises a truss header similar to the header 202 of FIG. 10 and including an upper horizontal chord 306 (shown as two flush beams), a lower horizontal chord 308, header web members 310, and header truss plates 312 substantially as described above with respect to FIG. 10. Each column 304 preferably includes two vertical posts 314 and 316, which are preferably sandwich posts with holdowns 318 as illustrated. In the illustrated embodiment, the holdowns 318 are only provided in the outer sandwich posts, but holdowns could also be provided in the inner sandwich posts for greater strength. The holdowns are preferably of a type disclosed in the '042 and '767 patents. Each column 304 preferably also includes column web members 320, beam-separation blocks 322, column truss plates 324, and plate-support blocks 326 substantially as described above with respect to FIG. 10. Connection truss plates 328 are provided for connecting the header 302 to the columns 304 and are preferably similar to the connection truss plates 228 described above. The connection truss plates 328 can include strips or band-aids as described above with respect to FIG. 10D. Although not shown, horizontal compression plates, like the plates 262 of FIG. 10, can be interposed between the header 302 and the studs of the posts 314 and 316 to prevent point-loading of such studs against the lower surface of the header. In each column 304, the outer stud 330 of the sandwich post 314 preferably extends vertically upward to the upper chord 306 of the header 302, which provides a more rigid connection of the header 302 and the columns 304.

The sill structure 305 defines a lower end of the window opening 301. In the illustrated embodiment, the sill structure 305 comprises a sill truss having an upper horizontal chord 332 (which is shown as two flush beams but which could alternatively be a single beam), a lower horizontal chord 334, sill web members 336, and pairs of sill truss plates 338. The illustrated sill truss 305 extends laterally across the entire truss frame 300 so that it is positioned below the bottom ends of the columns 304. However, the outer studs 330 of the columns 304 preferably extend along the sides of the sill truss 305 all the way to the bottom of the truss frame 300, which provides for a more rigid connection of the columns 304 to the still truss. The connection of the columns 304 to the sill truss 305 is strengthened by the use of connection truss plates 340 that are similar to the connection truss plates 328 secured to the header 302. The connection truss plates 340 can include strips or band-aids as described above with respect to FIG. 10D. Although not shown, horizontal compression plates, like the plates 262 of FIG. 10, can be interposed between the sill structure 305 and the studs of the posts 314 and 318 to prevent point-loading of such studs against the upper surface of the sill structure. In order for the holdowns 318 to be secured (e.g., via a tie member such as a rod) to a structural element below the wall (such as a building foundation or a structural element of a lower story of the building), it is necessary to drill vertical holes through all of the portions of the truss frame 300 that are below the holdowns. For example, it is necessary to drill holes through the plate-support blocks 326, upper chord 332, intervening sill web members 336, and lower chord 334.

Truss Panels

FIGS. 12-15 illustrate wall segments configured to transmit lateral loads down into a foundation. As these wall segments contain internal reinforcement members, they are referred to herein as "truss panels."

Figure 12:
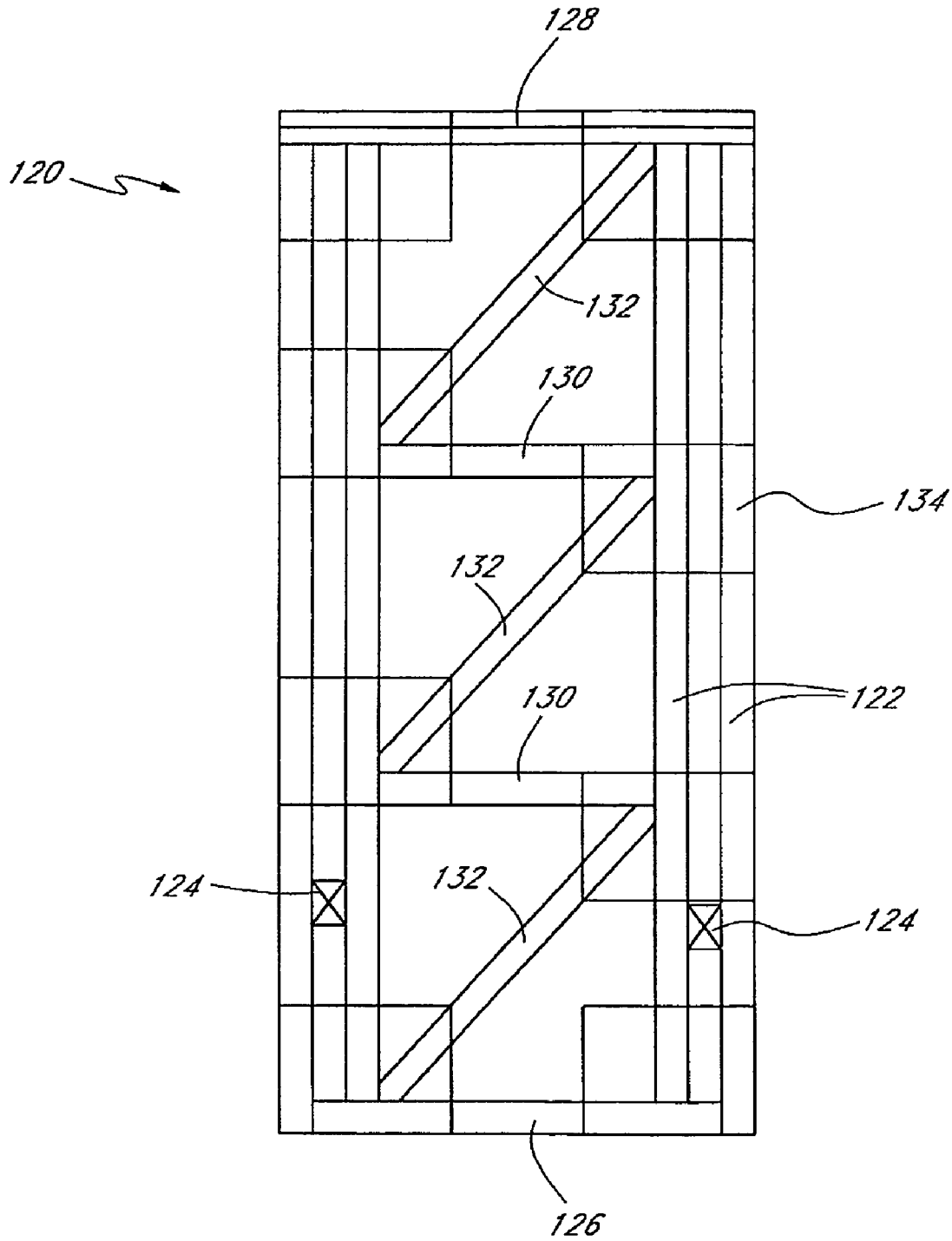
FIG. 12 is a side view of a truss panel according to one embodiment of the invention.

FIG. 12 shows a truss panel 120 comprising four vertical studs 122, a lower horizontal chord 126, and an upper horizontal chord 128 (comprising two flush beams). The studs 122 are provided in pairs, each pair comprising a sandwich post in conjunction with a holdown 124. The truss panel 120 further includes internal reinforcement web members 130 and 132. The members 130 are horizontal and the members 132 are diagonal. Truss plate pairs 134 reinforce the connections of the web members 130 and 132 with each other and with the studs 122, chord 126, and chord 128. Although shown extending from top-right to bottom-left, the diagonal web members 132 could extend from top-left to bottom-right.

Figure 13:
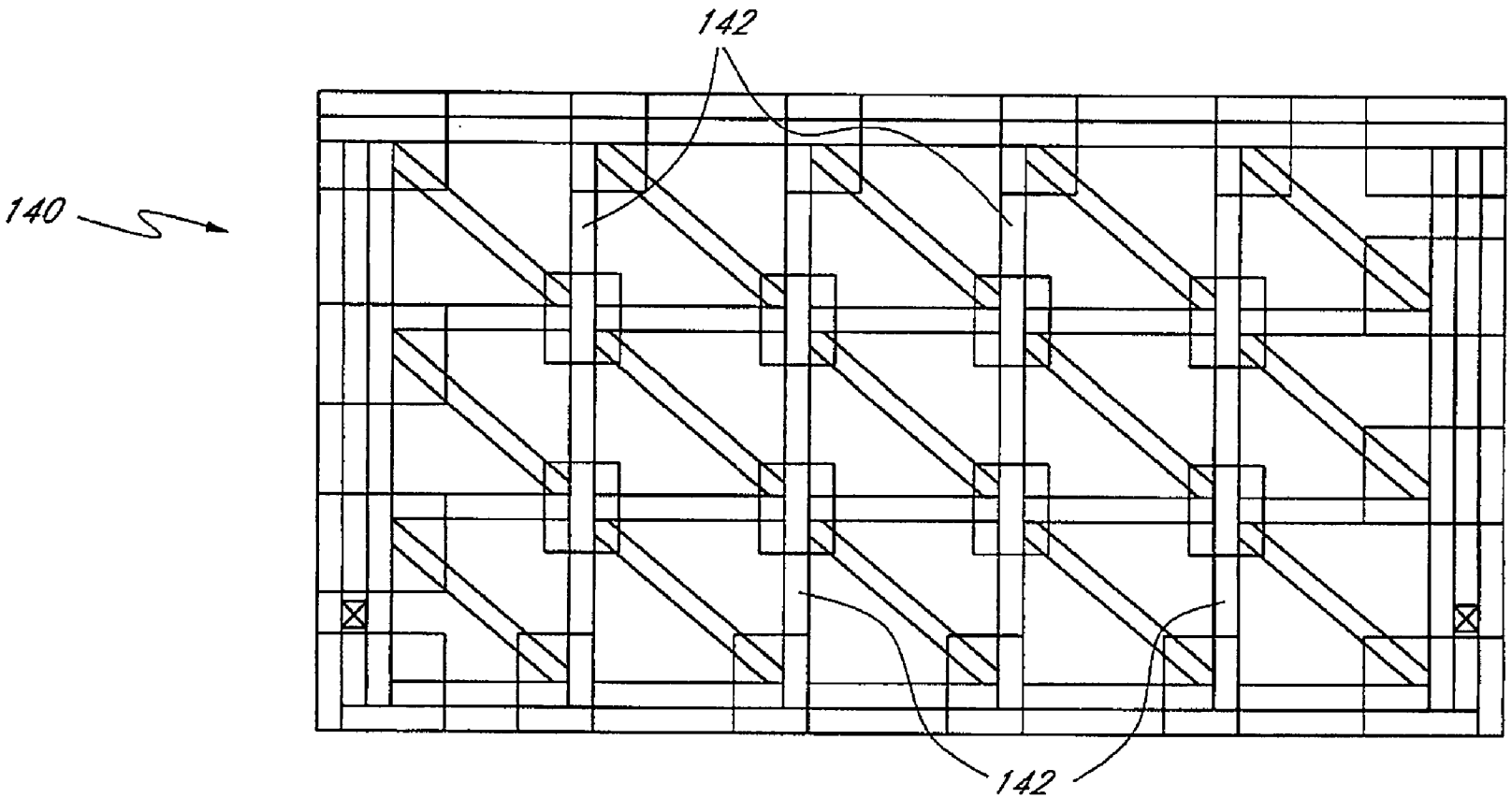
FIG. 13 is a side view of a truss panel according to another embodiment of the invention.

FIG. 13 shows an enlarged truss panel 140 that is similar to the truss panel 120 shown in FIG. 12, with the exception that the truss panel 140 includes a plurality of internal vertical chords 142 and additional web members 130 and 132 therebetween. The vertical chords 142 extend from the bottom horizontal chord to the top horizontal chord of the truss panel 140. This configuration permits the truss panel to extend further. Preferably, the chords 142 are spaced so as to facilitate standardized attachment of wall sidings, such as sheetrock. Preferably, the chords 142 are spaced apart by 16 inches.

Figure 14:
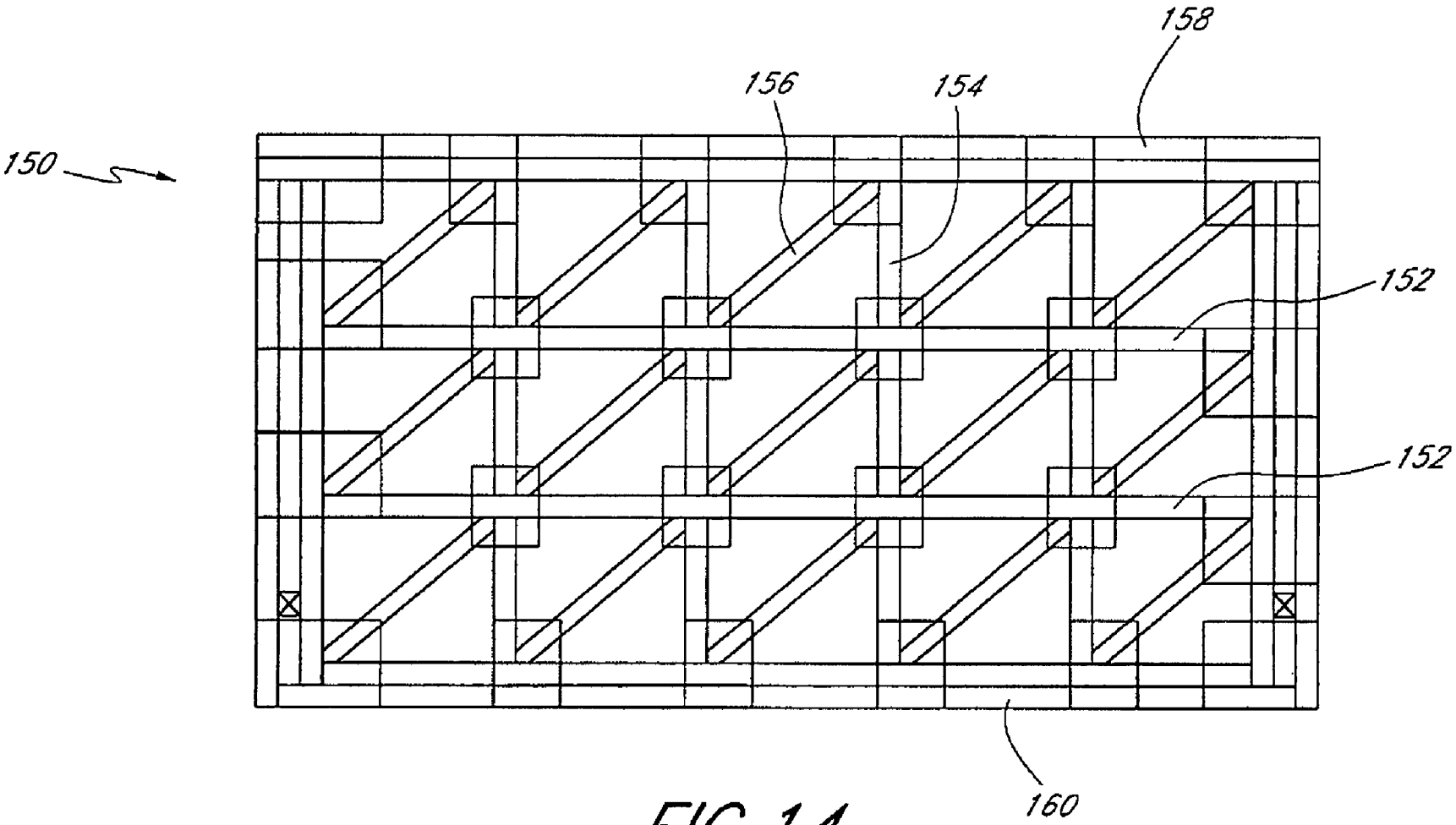
FIG. 14 is a side view of a truss panel according to another embodiment of the invention.

FIG. 14 shows an enlarged truss panel 150 that is similar to the truss panel 140 shown in FIG. 13, with the exception that instead of internal vertical chords the truss panel 150 includes internal horizontal chords 152. The horizontal chords 152 extend along the entire distance between the two sandwich posts of the truss panel 150. The truss panel 150 includes vertical reinforcement web members 154 and diagonal reinforcement web members 156. The vertical members 154 extend between the horizontal chords 152, as well as between such chords and the upper chord 158 and lower chord 160. Like the vertical chords 142 of FIG. 15, the vertical members 154 are preferably spaced apart so as to facilitate attachment of wall sidings. Preferably, the vertical members 154 are spaced apart by 16 inches.

Figure 15:
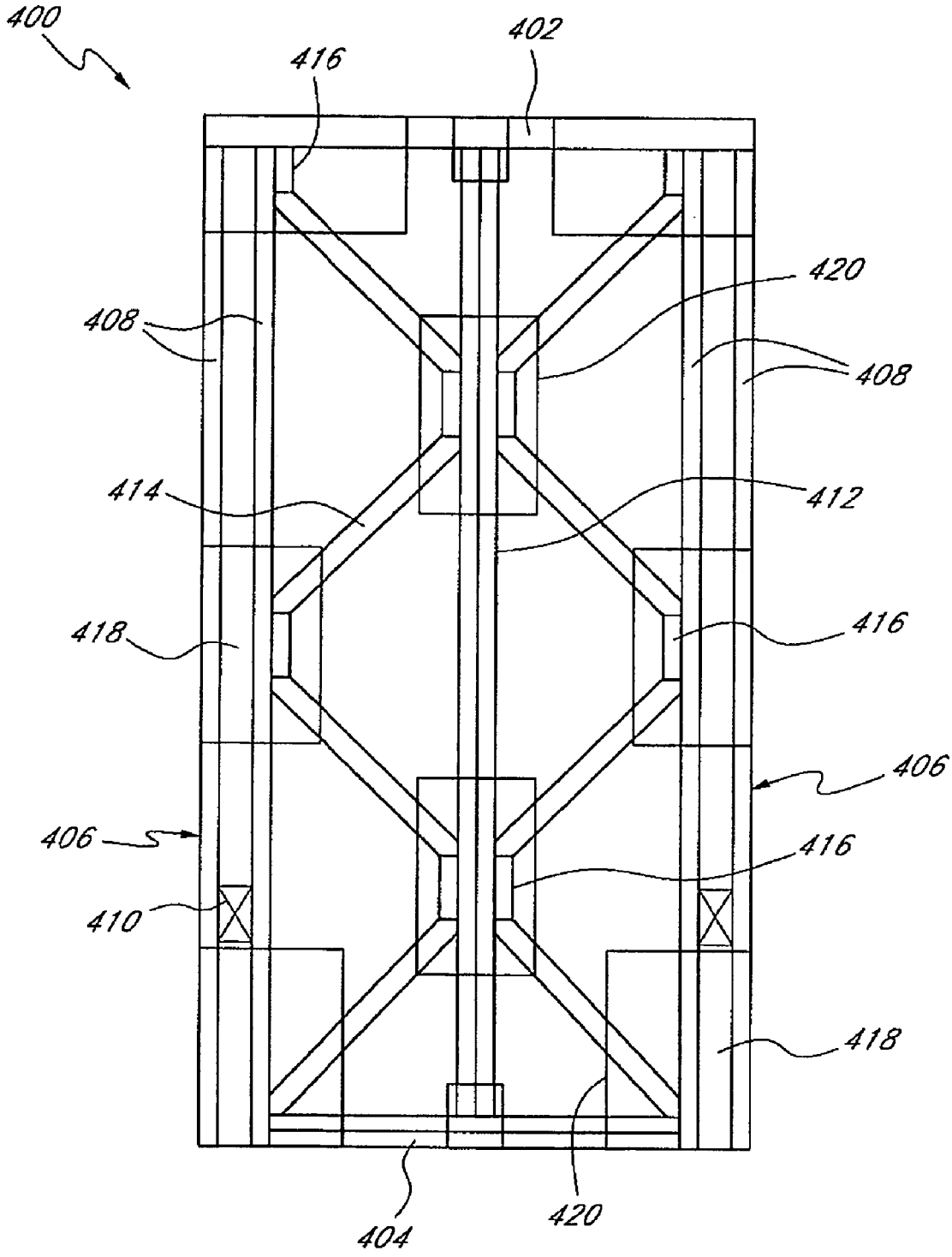
FIG. 15 is a side view of a truss panel according to another embodiment of the invention.

FIG. 15 shows a truss panel 400 according to another embodiment of the invention. The truss panel 400 includes an upper horizontal chord 402, a lower horizontal chord 404 (which is shown as two flush beams but could alternatively be a single beam), two vertical posts 406 defining the lateral ends of the truss frame, a central vertical chord 412 (which is shown as two flush beams but could alternatively be a single beam), panel web members 414 between the chord 412 and each of the posts 406, beam-separation blocks 416 bearing against ends of the web members 414 and against the chord 412 and posts 406, and pairs of panel truss plates 420. All of these elements are substantially as described above with reference to the embodiments of FIGS. 10-10D and 11. In the illustrated embodiment, the upper chord 402 extends laterally across the entire truss panel 400, and the lower chord 404 extends only to the inner surfaces of the posts 406. The posts 406 are preferably sandwich posts comprising vertical studs 408 and holdowns 410 as described above. The beam-separation blocks 416 that bear against the sandwich posts 406 are preferably somewhat longer than those that bear against the chord 412. This is because the load path defined by the sandwich posts 406 is laterally spaced further away from the adjacent web members 414 than the load path defined by the chord 412 is from its adjacent web members 414.

The truss panel 400 preferably also includes plate-support blocks 418 that help support the truss plates 420 that are secured at the connections of the posts 406, web members 414, and beam-separation blocks 416 that bear against the posts 406. The plate-support blocks 418 are analogous to the plate-support blocks 260 and 326 of FIGS. 10 and 11, respectively. The plate-support blocks 418 are preferably positioned between the vertical studs 408 of each sandwich post 406 and located at about the levels of the beam-separation blocks 416 that bear against the studs 408. Additional plate-support blocks 418 may also be provided at the bottom corners of the truss panel 400 to support the pairs of truss plates 420 at such corners. If such additional plate-support blocks 418 are provided, vertical holes must be drilled through them to allow for passage of the tie-member or other securing element of the holdowns 410.

Truss Walls

Figure 16:
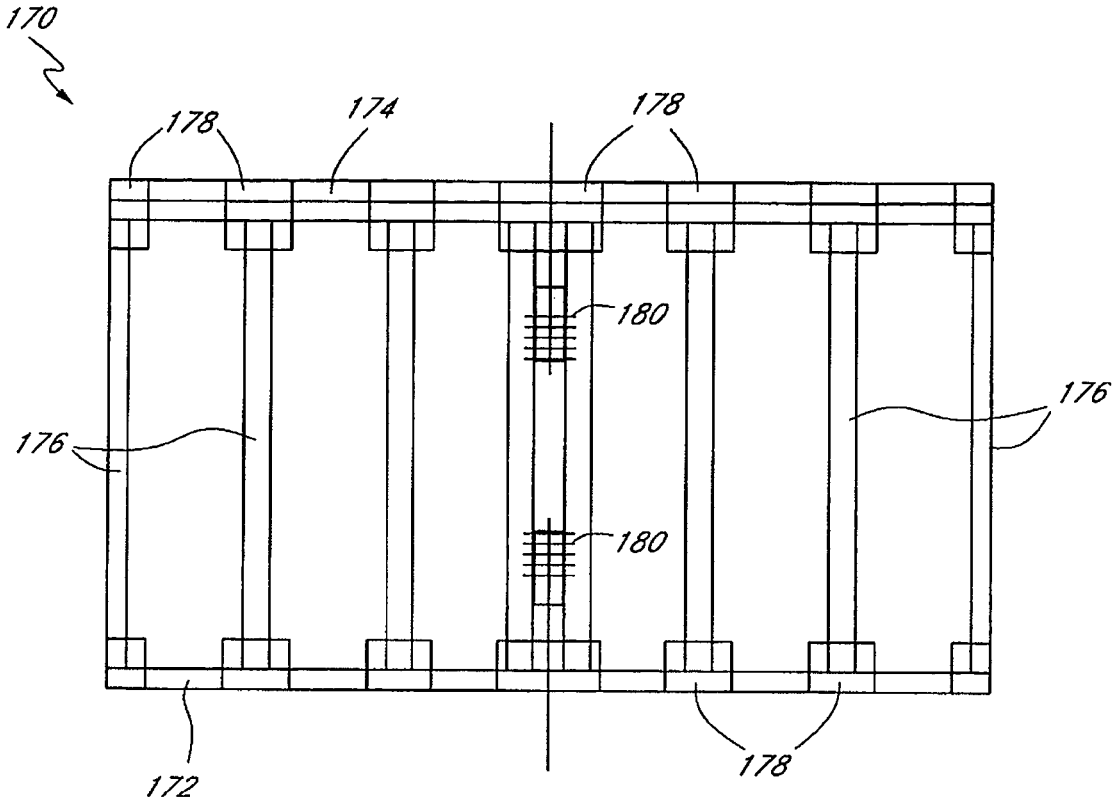
FIG. 16 is a side view of a truss wall according to one embodiment of the invention.

Another embodiment of the present invention is a "truss wall," a large wall segment designed for light loads, such as interior walls. FIG. 16 shows a truss wall 170 including a bottom horizontal chord 172, a top horizontal chord 174 (comprising two members flush together), and a plurality of vertical studs 176 extending therebetween. Bottom chords 172 and top chords 174 are analogous to top plates and bottom plates described above. The vertical studs 176 are preferably spaced apart so as to facilitate attachment of wall sidings, such as sheetrock. Preferably, the studs 176 are spaced apart by 16 inches. The truss wall 170 can include any number of vertical studs 176, to suit the desired length of the wall. Truss plate pairs 178 are provided to reinforce the connections of the vertical studs 176 to the bottom chord 172 and the top chord 174. Truss plates 178 can be installed so that they extend past the bottom chord 172 and top chord 174 to provide a means of attaching the truss wall 170 to the building structure. The truss plates 178 permit the truss wall 170 to take some shear loads as well. For added strength, the truss wall 170 can include one or more internal sandwich posts with holdowns 180 as shown. The truss wall 170 can also include web members between the studs 176. In one embodiment, the web members are arranged similarly to the web members 246 in the columns 204 of the truss frame 200 of FIG. 10, optionally with beam separation blocks between the ends of the web members. The truss wall 170 can also include compression plates interposed between the ends of the studs 176 and the surfaces of the top and bottom chords 172 and 174, to prevent point-loading of the chords.

The illustrated truss wall 170 includes one sandwich post containing two holdowns 180. One of the holdowns 180 secures the truss wall 170 to a structural element below, while the other holdown 180 secures the truss wall 170 to a structural element above. It should be noted that for many of the embodiments of wall segments of the invention (including truss panels and truss walls), it is possible to have (1) holdowns securing the wall segment to a structural element above, (2) holdowns securing the wall segment both above and below, and (3) holdowns extending through multiple floors of a building.

Manufacturing Methods

The following is a description of preferred methods of manufacturing the above-described load-resisting truss segments. The following description is primarily directed to methods that are at least partially automated, but it will be understood that these manufacturing steps can be conducted in a completely manual process. Manual methods may be preferred in some cases in which it is not cost-effective to invest in equipment for automated manufacturing. Skilled artisans will also understand that the truss segments can alternatively be formed according to methods other than those described below.

A preferred manufacturing method begins with detailed truss design information in the form of, for example, a drawing or a data file readable by a computer. The truss design information can be created using matrix methods engineering analysis. The truss design information preferably includes a listing of all of the individual parts of the truss segment, including every elongated chord (a "chord" includes vertical and horizontal studs or beams), block, truss plate, band-aid, compression plate, holdown member, web member, etc. The truss design information preferably also includes overall dimensions of these parts, as well as dimensions of any openings in the truss segment. The individual parts can be sequentially numbered in a bill of materials format for manufacturing.

In embodiments in which the truss segment is primarily formed of wood, the wooden members are preferably cut to size by the use of a saw. The truss design information preferably includes a detailed cut list identifying all of the saw cuts to be made. The saw cut list is sent to a preferably computer-controlled saw that cuts raw wood members to form the wooden parts of the assembly. The truss design information is preferably configured to optimize the use of wood so that there is little if any wooden waste. The cut pieces of wood are then appropriately marked (e.g., numbered) for identification purposes to facilitate later assembly. The marking can be done by automated equipment, such as by the saw itself.

The next step in the process is to assemble the pieces of the truss segment together. The beams, web members, compression plates (if any), and other parts (but not the truss plates) are placed onto a strong, rigid assembly table that has a very flat surface or "working plane." The table preferably also includes "fences," i.e., elements that extend vertically from the working plane and prevent lateral movement of one or more of the parts of the truss segment. The lateral positions of the fences are preferably adjustable. The fences preferably outline the overall dimensions of the truss segment, as well as any openings (if any) in the truss segment. The process preferably involves automated equipment that sorts and positions the pieces of the truss segment onto the working plane, so that all of the pieces occupy the positions they are to have in the completed truss segment. One or more lateral presses are preferably utilized to push all of the pieces against the fences to obtain a tight fit. Corrugated fasteners may be used at the joints to hold the pieces into the desired positions.

Once all of the pieces are sorted and positioned on the working plane and the press is pushing the pieces against the fences, the truss plates are then secured to sides of the pieces. In a preferred embodiment, the assembled pieces are formed of wood and the truss plates are metal and have punched teeth, such as the teeth described in the '176 patent. The truss plates are laid onto the wood pieces and then a press is utilized to apply downward force onto the truss plates to cause the teeth of the truss plates to pierce into and securely engage the wood pieces. In one embodiment, the press comprises one or more rollers of the assembly table, the rollers preferably being vertically movable with respect to the working plane to accommodate truss segments of different thicknesses. The rollers roll across the entire truss with sufficient force to set the truss plates. In another embodiment, the press comprises a vertical press that is positioned over the truss plates and then moved downward to press the truss plates into the wood pieces. After the truss plates are secured to the wood pieces, the assembly is lifted off of the working plane and flipped upside down. Then, additional truss plates are laid onto the opposite side of the assembly and then the press is utilized to press such truss plates into the wood pieces. In this way, the truss plates are secured to both sides of the truss segment. There is of course no need to flip the truss segment over and put press on additional truss plates if the design only calls for truss plates on one side of the segment.

In a simpler method, a first set of truss plates are first laid onto the working plane first, with punched teeth pointed upward. The remaining pieces of the truss segment are then placed onto the first set of truss plates in the positions that the pieces are to have in the desired truss segment. Then, a second set of truss plates are placed onto the top of the assembly, with the punched teeth pointed downward. The press is then utilized to press the entire assembly together so that both sets of truss plates pierce into the wood pieces from both sides. Since this simplified method involves only one pressing, it is faster and involves fewer steps. However, it may be somewhat more difficult to position the truss plates with a high degree of accuracy.

After the truss plates are initially pressed onto the truss segment as described above, some of the truss plates may not be completely engaged onto the wood pieces. In one embodiment, the assembly is then moved to a secondary roller press for additional pressing of the truss plates onto the wood pieces. The secondary roller press preferably involves the use of rollers at two or more depths. This is particularly useful if the plate area is large. It may involve multiple passes of rollers at various depths to press the plates completely into the wood pieces.

After the press operation(s), the truss segment is preferably transferred to a packaging station for packaging multiple truss segments together. Truss segments designed for use in a single building structure are preferably packaged together. More preferably, the truss segments of a single building structure are bundled for delivery in a manner that permits them to be unbundled or unloaded from a truck in the order that they are to be installed in a building structure. This streamlines the process of constructing the building, so that the builder can unload or unbundled the truss segments and place them directly into the building structure as needed.

Depending upon building design, a truss segment may need to features for electrical lines, plumbing, insulation, and other building systems. For example, the truss segment may need holes for electrical lines or conduits (such as PVC piping) for plumbing. Since the presence of holes and conduits may affect the load-resisting performance of the truss segment, care should be taken in selecting where the holes or conduits are located. In one embodiment, the truss segment manufacturer provides field instructions on where and how to form the holes and install the conduits. In another embodiment, the truss segment manufacturer forms the holes and/or conduits in the manufacturing process. The formation of holes is optionally a step added to the wood member cutting process described above. The provision of conduits (such as PVC piping) is optionally a step added to the table assembly process described above. One problem with permitting the field labor to provide the holes and/or conduits is that the truss plates and wood pieces can inhibit the field labor. The denser a truss segment is with truss plates and wood pieces, the more difficult it is for field labor to form the holes and/or conduits. Thus, for denser truss segments it may be preferred to form the holes and/or conduits during the manufacturing process.

The manufacturer can also provide blown insulation that forms hard. If the manufacturer provides insulation, blown insulation is preferred over insulation batts held with wires because the batts may present difficulties with respect to transportation and on-site installation. As explained above, for denser truss segments it may be preferred to provide the insulation during the manufacturing process.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A load-resisting segment configured to be installed within a building wall formed above a structural element of a building, the segment comprising:

a first substantially vertical stud;

a second substantially vertical stud spaced from the first stud, wherein the first and second studs receive a rigid member that is secured to both of the first and second studs and that engages an upper portion of a substantially vertical rod that has a lower portion configured to be secured to the structural element below the wall, so that the rigid member and the rod form at least a part of a holdown that is configured to prevent the first and second studs from moving upward relative to the structural element;

a third substantially vertical stud spaced from the second stud so that the second stud is between the first and third studs;

a first web member oriented diagonally between the second and third studs, the first web member having a top end with a lateral surface bearing against the third stud, the first web member having a bottom end with a lateral surface and a bottom surface, the lateral surface of the bottom end of the first web member bearing against the second stud;

a beam-separation block with a top surface, a lateral surface, and a bottom surface, the top surface of the beam-separation block bearing against the bottom surface of the bottom end of the first web member, the lateral surface of the beam-separation block bearing against the second stud; and a second web member oriented diagonally between the second and third studs, the second web member having a top end with a top surface and a lateral surface, the top surface of the top end of the second web member bearing against the bottom surface of the beam-separation block, the lateral surface of the top end of the second web member bearing against the second stud, the second web member having a bottom end with a lateral surface bearing against the third stud;

wherein the beam-separation block is sized and shaped so that a load path defined by the first web member and a load path defined by the second web member intersect substantially on a line that is collinear with the rod when the rigid member is secured to both the first and second studs and is engaged with the rod.

2. The segment of claim 1, further comprising a first plate secured to first sides of the first stud, second stud, first web member, second web member, and beam-separation block.

3. The segment of claim 2, further comprising a second plate secured to second sides of the first stud, second stud, first web member, second web member, and beam-separation block, the second sides being opposite the first sides, such that the first and second plates are on opposite sides of the load-resisting segment.

4. The segment of claim 2, wherein the first plate includes teeth formed by punching holes in the first plate, the teeth piercing into and engaging the first sides of the first stud, second stud, first web member, second web member, and beam-separation block.

5. The segment of claim 4, wherein the teeth of the first plate are formed by punching said holes individually with a punching element and then twisting the punching element to form an angularity to the teeth.

6. The segment of claim 2, further comprising a plate-support block positioned between the first and second studs at an intersection point of the load path defined by the first web member and the load path defined by the second web member.

7. The segment of claim 6, wherein the plate-support block has upper and lower ends that are coextensive with edges of the first plate.

8. The segment of claim 2, wherein the first stud, second stud, third stud, first web member, second web member, and beam-separation block are formed of wood and the first plate is formed of metal.

9. The segment of claim 1, further comprising:

a third web member oriented diagonally between the second and third studs, the third web member having a top end with a lateral surface and a top surface, the lateral surface of the top end of the third web member bearing against the third stud, the top surface of the top end of the third web member configured to receive loads transmitted through the second web member, the third web member having a bottom end with a lateral surface and a bottom surface, the lateral surface of the bottom end of the third web member bearing against the second stud;

a second beam-separation block with a top surface, a lateral surface, and a bottom surface, the top surface of the second beam-separation block bearing against the bottom surface of the bottom end of the third web member, the lateral surface of the second beam-separation block bearing against the second stud; and a fourth web member oriented diagonally between the second and third studs, the fourth web member having a top end with a top surface and a lateral surface, the top surface of the top end of the fourth web member bearing against the bottom surface of the second beam-separation block, the lateral surface of the top end of the fourth web member bearing against the second stud, the fourth web member having a bottom end with a lateral surface bearing against the third stud;

wherein the second beam-separation block is sized and shaped so that a load path defined by the third web member and a load path defined by the fourth web member intersect substantially on the line that is collinear with the rod when the rigid member is secured to both the first and second studs and is engaged with the rod.

10. The segment of claim 1, wherein the segment is installed within a wall of a building, and wherein the structural element comprises a building foundation.

11. The segment of claim 1, wherein the segment comprises a frame configured to receive one of a door and a window.

12. A substantially rigid frame for an opening of a wall of a building, comprising:

a first substantially vertical column comprising a first substantially vertical post and a second substantially vertical post spaced laterally from the first post;

a second substantially vertical column comprising a third substantially vertical post and a fourth substantially vertical post spaced laterally from the third post, the second column spaced laterally from the first column so that the second and third posts define ends of a wall opening, the wall opening configured to receive one of a door and window;

a substantially horizontal header having a first end positioned above the first column and a second end positioned above the second column, wherein the header, the first column, and the second column collectively comprise a substantially rigid framework;

a plurality of substantially horizontal compression plates interposed between upper ends of the posts and lower surfaces of the header, wherein an area of contact between an upper surface of each compression plate and a lower surface of the header is larger than an area of contact between an upper end of one of the posts and a lower surface of the compression plate, such that each compression plate spreads out loads transmitted from one of the posts into the header, the compression plates formed of a material stronger than that of portions of the posts and header in contact with the compression plates; and one or more truss plates secured to a side of the header and to a side of at least one of the posts, the one or more truss plates configured to share loads transmitted within the header and/or posts;

wherein the frame is configured so that when installed in a wall of the building, loads within the header may be transmitted vertically through the columns to a structural element of the building, the structural element being below the wall;

wherein each of the posts comprises two substantially vertical studs spaced laterally apart from each other, a rigid member positioned between and secured to both of the studs, and a substantially vertical rod having an upper portion engaged with the rigid member, the rod having a lower portion configured to be secured to the structural element below the wall, so that the rigid member and the rod form at least part of an assembly that is configured to prevent the two studs from moving upward relative to the structural element;

wherein the first column includes first and second web members each oriented diagonally between the first and second posts, both of the web members having an end bearing against a particular one of the studs of one of the first and second posts, the first and second web members respectively defining first and second load paths, the web members being oriented so that the first and second load paths intersect substantially on a line that is collinear with the rod of said one of the first and second posts.

13. The frame of claim 12, wherein the plurality of compression plates comprises a first compression plate in contact with an upper end of the first post, a second compression plate in contact with an upper end of the second post, a third compression plate in contact with an upper end of the third post, and a fourth compression plate in contact with an upper end of the fourth post.

14. The frame of claim 12, wherein the wall opening is configured to receive a window, the frame further comprising:

a sill structure spaced below the header and defining a bottom of the wall opening; and a plurality of horizontal compression plates interposed between lower ends of the posts and upper surfaces of the sill structure.

15. A substantially rigid frame for an opening of a wall of a building, comprising:

a first substantially vertical column;

a second substantially vertical column spaced laterally from the first column so that a wall opening can be formed between the first and second columns, the wall opening configured to receive one of a door and a window;

a substantially horizontal header having a first end positioned above the first column and a second end positioned above the second column; and a plurality of truss plates each secured to a side of the first or second column and/or the header;

wherein the header, the first column, the second column, and the truss plates collectively comprise a substantially rigid framework through which, when the frame is installed in a wall of a building, loads can be transmitted into a structural element below the wall, each of the first and second columns comprising a first pair of substantially vertical studs laterally spaced from one another and receiving a rigid member positioned between and secured to both of the studs, the rigid member engaging an upper portion of a substantially vertical rod that has a lower portion configured to be secured to the structural element below the wall when the frame is installed within the wall, so that the rigid member and the rod form at least part of an assembly that prevents the studs from moving upward relative to the structural element;

wherein at least one of the columns further comprises first and second web members each oriented diagonally with respect to the studs of the column, each of the web members having an end bearing against a particular one of the studs, the first and second web members respectively defining first and second load paths, the web members being oriented so that the first and second load paths intersect substantially on a line that is collinear with the rod of the column;

wherein the truss plates comprise:

one or more truss plates secured to both the first column and the header, and collectively spanning a majority of a width of the first column; and one or more truss plates secured to both the second column and the header, and collectively spanning a majority of a width of the second column.

16. The frame of claim 15, wherein the first and second columns define ends of the wall opening.

17. The frame of claim 15, wherein the wall opening is configured to receive a window, the frame further comprising a sill structure spaced below the header, an upper surface of the sill structure defining a bottom of the wall opening.

18. The frame of claim 17, wherein the sill structure comprises:

a substantially horizontal bottom sill chord extending underneath both of the columns;

a substantially horizontal top sill chord spaced above the bottom sill chord, the upper surface of the sill structure being an upper surface of the top sill chord;

a plurality of sill web members extending between the top and bottom sill chords; and sill truss plates secured to sides of the sill structure, at least some of the sill truss plates securing connections between at least one of the sill web members with one of the top sill chord and the bottom sill chord.

19. The frame of claim 18, wherein the sill structure further comprises substantially horizontal compression plates interposed directly between the upper surface of the top sill chord and bottom ends of the columns.

20. The frame of claim 15, wherein each of the columns further comprises:

a second pair of substantially vertical studs spaced laterally from each other, the second pair of studs also spaced laterally from the first pair of studs of the column; and a second rigid member positioned between the studs of the second pair of studs and being secured to the second pair of studs, the second rigid member engaging an upper portion of a second substantially vertical rod that has a lower portion configured to be secured to the structural element below the wall when the frame is installed within the wall, to prevent the second pair of studs from moving upward relative to the structural element.

21. A segment configured to be installed within a building wall formed above a structural element of a building, the segment comprising:

a first substantially vertical stud;

a second substantially vertical stud spaced from the first stud, wherein the first and second studs receive a rigid member that is secured to both of the first and second studs and that engages an upper portion of a substantially vertical rod that has a lower portion configured to be secured to the structural element below the wall, so that the rigid member and the rod form at least a part of a holdown that is configured to prevent the first and second studs from moving upward relative to the structural element;

a third substantially vertical stud spaced from the second stud so that the second stud is between the first and third studs;

a first web member oriented diagonally between the second and third studs, the first web member having a top end bearing against the third stud and a bottom end bearing against the second stud, the first web member defining a first load path; and a second web member oriented diagonally between the second and third studs, the second web member having a top end bearing against the second stud and a bottom end bearing against the third stud, the second web member defining a second load path;

wherein the first and second web members are oriented so that the first and second load paths intersect substantially on a line that is collinear with the rod when the rigid member is secured to both the first and second studs and is engaged with the rod.

22. The segment of claim 21, further comprising:

a first plate secured to a first side of the segment, the first plate fixing at least one of the studs together with a beam at a connection point between the stud and the beam, the first plate overlying portions of the stud and the beam, each of said portions of the stud and the beam defining a load path and being configured to transmit loads that are shared by the first plate, wherein when the segment is under a load the load paths shared by the first plate result in a first net load in a first portion of the first plate and a second net load in a second portion of the first plate, the directions of the first and second net loads being generally opposite to one another; and a first strip of material formed separately from the first plate and non-movably engaged with the first plate along a border between the first and second portions of the first plate, the first strip of material configured to resist tearing of the first plate along the border, the first strip of material extending across a length of the first plate.

23. The segment of claim 22, wherein the stud and the beam are formed of wood and the first plate and first strip of material are formed of metal.

24. The segment of claim 23, wherein the first plate includes teeth formed by punching holes in the first plate, the teeth piercing into and engaging the portions of the stud and the beam.

25. The segment of claim 22, further comprising:

a second plate secured to a second side of the segment, the second side being opposite the first side, the second plate fixing said at least one of the studs together with the beam at the connection point between the stud and the beam, the second plate overlying said portions of the stud and the beam, each of said portions of the stud and the beam being configured to transmit loads that are oriented along said load paths and shared by the second plate, wherein when the segment is under said load the load paths shared by the second plate result in a first net load in a first portion of the second plate and a second net load in a second portion of the second plate, the directions of the first and second net loads in the second plate being generally opposite to one another; and a second strip of material formed separately from the first plate and non-movably engaged with the second plate along a border between the first and second portions of the second plate, the second strip of material configured to resist tearing of the second plate along the border between the first and second portions of the second plate, the second strip of metal extending across a length of the second plate.

26. The segment of claim 22, wherein the load-resisting segment comprises a frame for a wall opening configured to receive one of a door and a window, the frame comprising first and second columns at opposite ends of the wall opening, the beam forming a chord of a header above the wall opening.

27. The segment of claim 22, wherein the load-resisting segment comprises a panel in the wall.

28. The segment of claim 21, further comprising:

a horizontal beam having a side positioned at an end of one of the studs; and a compression plate interposed between the end of said one of the studs and the side of the beam, the compression plate having a substantially flat surface in substantially flush contact with the side of the beam, wherein an area of contact between the compression plate and the beam is larger than an area of contact between the end of said one of the studs and the compression plate, such that the compression plate spreads out loads transmitted from said one of the studs into the beam, the compression plate formed of a material stronger than that of said one of the studs and the beam.

29. A load-resisting segment configured to be installed within a building structure, the load-resisting segment comprising:

a first beam;

a second beam substantially parallel to and spaced from the first beam, wherein the first and second beams receive a rigid member that is secured to both of the first and second beams and that engages a first portion of a rod that has a second portion configured to be secured to a structural element of the building structure, so that the rigid member and the rod form at least a part of an assembly that is configured to prevent the first and second beams from moving away from the structural element;

a third beam substantially parallel to and spaced from the second beam so that the second beam is between the first and third beams;

a first web member oriented diagonally between the second beam and the third beam, the first web member having a first end with a beam-abutting surface bearing against the third beam, the first web member having a second end with a beam-abutting surface and a block-abutting surface, the beam-abutting surface of the second end of the first web member bearing against the second beam;

a web-spacer block with a first web-abutting surface, a beam-abutting surface, and a second web-abutting surface, the first web-abutting surface of the web-spacer block bearing against the block-abutting surface of the second end of the first web member, the beam-abutting surface of the web-spacer block bearing against the second beam;

a second web member oriented diagonally between the second beam and the third beam, the second web member having a first end with a block-abutting surface and a beam-abutting surface, the block-abutting surface of the first end of the second web member bearing against the second web-abutting surface of the web-spacer block, the beam-abutting surface of the first end of the second web member bearing against the second beam, the second web member having a second end with a beam-abutting surface bearing against the third beam; and a truss plate secured to sides of the second beam, the first web member, the second web member, and the web-spacer block;

wherein the web-spacer block is sized and shaped so that a line that is collinear with a primary load path of the first web member and a line that is collinear with a primary load path of the second web member intersect substantially on a line that is collinear with the rod when the rigid member is secured to both the first and second beams and is engaged with the rod.

30. The load-resisting segment of claim 29, wherein the segment comprises a portion of a floor of the building structure.

31. The load-resisting segment of claim 29, wherein the segment comprises a portion of a roof of the building structure.

32. The load-resisting segment of claim 29, wherein the segment comprises a portion of a ceiling of the building structure.

33. The load-resisting segment of claim 29, installed within a vertical wall of a building structure.

34. A substantially rigid load-resisting frame for an opening of a building structure, comprising:

a first structural border for an opening in a planar partition of the building structure, the first structural border comprising a first pair of elongated spaced apart parallel beams and a second pair of elongated spaced apart parallel beams, the second pair of beams being generally parallel to and spaced laterally from the first pair of beams;

a second structural border for the opening, the second structural border comprising a third pair of elongated spaced apart parallel beams and a fourth pair of elongated spaced apart parallel beams, the fourth pair of beams being generally parallel to and spaced laterally from the third pair of beams, the second structural border spaced laterally from the first structural border so that the opening is formed between the second and third pairs of beams;

a third structural border for the opening, the third structural border having a first end portion positioned adjacently to an end of the first structural border and a second end portion positioned adjacently to an end of the second structural border, wherein the structural borders collectively comprise a substantially rigid framework;

a first truss plate secured to front sides of the first pair of beams and the third structural border; and a second truss plate secured to front sides of the second pair of beams and the third structural border, the first and second truss plates overlying a majority of the entire distance between the first and second pairs of beams;

wherein the first and second truss plates share loads transmitted between the first and third structural borders;

wherein a particular one of the first and second pairs of beams includes a rigid member positioned between and secured to both of the beams, and a rod substantially parallel to the beams and having a first portion engaged with the rigid member, the rod having a second portion configured to be secured to a structural element of the building, so that the rigid member and the rod form at least part of an assembly that is configured to prevent the two beams from moving away from the structural element;

wherein the first structural border includes first and second web members each oriented diagonally with respect to the rod, both of the web members having an end bearing against a particular beam of said particular one of the first and second pairs of beams, the first and second web members respectively defining first and second load paths, the web members being oriented so that the first and second load paths intersect substantially on a line that is collinear with the rod.

35. The load-resisting frame of claim 34, further comprising:

a third truss plate secured to front sides of the third pair of beams and the third structural border; and a fourth truss plate secured to front sides of the fourth pair of beams and the third structural border, the third and fourth truss plates overlying a majority of the entire distance between the third and fourth pairs of beams;

wherein the third and fourth truss plates share loads transmitted between the second and third structural borders.

36. The load-resisting frame of claim 34, wherein the frame comprises a portion of a wall of the building structure, the third border structure comprising a header with end portions positioned above upper ends of the first and second structural borders, the frame being configured so that loads within the header are transmitted through the first and second structural borders to a structural element below the wall.

37. The load-resisting frame of claim 36, wherein the structural element comprises a foundation below the wall.

38. The load-resisting frame of claim 36, wherein the opening is configured to receive a window, the frame further comprising a sill structure spaced below the header and defining a bottom of the opening.

39. The load-resisting frame of claim 36, wherein the opening is configured to receive a door.

40. The load-resisting frame of claim 36, wherein the header comprises:

an upper substantially horizontal chord;

a lower substantially horizontal chord spaced below the upper chord, the lower chord defining an upper end of the opening;

a set of header web members extending between the upper and lower chords and having ends positioned to transmit loads to others of the header web members; and a plurality of header truss plates, at least one of which is secured to ends of two or more of the header web members and to one of the upper and lower chords;

wherein the set of header web members and the header truss plates are configured to share loads transmitted within the upper and lower chords.

41. The load-resisting frame of claim 40, wherein the opening is configured to receive a window, the frame further comprising a sill truss comprising:

an upper sill chord spaced below the lower chord of the header, the upper sill chord defining a bottom of the opening;

a lower sill chord spaced below the upper sill chord;

a set of sill web members extending between the upper and lower sill chords and having ends positioned to transmit loads to others of the sill web members; and a plurality of sill truss plates, at least one of which is secured to ends of two or more of the sill web members and to one of the upper and lower sill chords;

wherein the set of sill web members and the sill truss plates are configured to share loads transmitted within the upper and lower sill chords.

42. The load-resisting frame of claim 36, further comprising:

a first set of web members extending between the first and second pairs of beams and having ends positioned to transmit loads to others of the first set of web members;

a first set of column truss plates secured to the first pair of beams, second pair of beams, and first set of web members, the first set of column truss plates securing connections of the first set of web members to the first and second pairs of beams, wherein the first set of web members and the first set of column truss plates are configured to share loads transmitted within the first and second pairs of beams;

a second set of web members extending between the third and fourth pairs of beams and having ends positioned to transmit loads to others of the second set of web members; and a second set of column truss plates secured to the third pair of beams, fourth pair of beams, and second set of web members, the second set of column truss plates securing connections of the second set of web members to the third and fourth pairs of beams, wherein the second set of web members and the second set of column truss plates are configured to share loads transmitted within the third and fourth pairs of beams.

43. The load-resisting frame of claim 42, further comprising blocks positioned against the pairs of beams and between ends of the web members, each of the blocks configured to transmit loads from an adjoining one of the web members to another adjoining one of the web members.

44. The load-resisting frame of claim 42, wherein at least some of the web members have an end bearing directly against another of the web members.

45. The load-resisting frame of claim 42, wherein:

the first set of web members is arranged so that its web members alternate between a first orientation extending diagonally downward from the first pair of beams to the second pair of beams and a second orientation extending diagonally downward from the second pair of beams to the first pair of beams, the first set of web members arranged so that their ends bear against one another or against intervening elements so that a load can be transmitted generally vertically through the entire first set of web members; and the second set of web members is arranged so that its web members alternate between a first orientation extending diagonally downward from the third pair of beams to the fourth pair of beams and a second orientation extending diagonally downward from the fourth pair of beams to the third pair of beams, the second set of web members arranged so that their ends bear against one another or against intervening elements so that a load can be transmitted generally vertically through the entire second set of web members.

* * * * *

UNITED STATES PATENT AND TRADEMARK OFFICE

CERTIFICATE OF CORRECTION

PATENT NO. : 7,634,888 B2
APPLICATION NO. : 10/962185
DATED : December 22, 2009
INVENTOR(S) : Cloyd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1315 days.

Signed and Sealed this

Ninth Day of November, 2010

David J. Kappos

David J. Kappos
*Director of the United States Patent and Trademark Office*